US010421280B2

(12) United States Patent
Hirata et al.

(10) Patent No.: US 10,421,280 B2
(45) Date of Patent: Sep. 24, 2019

(54) LIQUID EJECTING APPARATUS AND MAINTENANCE DEVICE

(71) Applicant: SEIKO EPSON CORPORATION, Tokyo (JP)

(72) Inventors: Shinji Hirata, Shiojiri (JP); Keiichiro Yoshino, Matsumoto (JP); Seiya Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/901,620

(22) Filed: Feb. 21, 2018

(65) Prior Publication Data

US 2018/0236773 A1 Aug. 23, 2018

(30) Foreign Application Priority Data

Feb. 22, 2017 (JP) ..... 2017-031390

(51) Int. Cl.
*B41J 2/165* (2006.01)

(52) U.S. Cl.
CPC ..... *B41J 2/16544* (2013.01); *B41J 2/16508* (2013.01); *B41J 2/16511* (2013.01); *B41J 2/16517* (2013.01); *B41J 2/16532* (2013.01); *B41J 2/16538* (2013.01); *B41J 2/16547* (2013.01); *B41J 2002/16514* (2013.01); *B41P 2235/21* (2013.01)

(58) Field of Classification Search
CPC ..... B41J 2/16544; B41J 2/16508; B41J 2/16538; B41J 2/16532; B41J 2/16517; B41J 2/16547; B41J 2/16511; B41J 2002/16514; B41P 2235/21
See application file for complete search history.

(56) References Cited

U.S. PATENT DOCUMENTS 7,740,335 B2 * 6/2010 Miyamoto ..... B41J 2/16538 347/33
7,959,256 B2 * 6/2011 Huang ..... B41J 2/16538 347/33
2003/0020779 A1 1/2003 Takahashi
2003/0122892 A1 7/2003 Lim
2005/0103894 A1 5/2005 Takahashi et al.
(Continued)

FOREIGN PATENT DOCUMENTS

JP 2001-138545 A 5/2001
JP 2002-30700 A 10/2002
(Continued)

OTHER PUBLICATIONS

IP.com search (Year: 2019).*

*Primary Examiner* — Lisa Solomon
(74) *Attorney, Agent, or Firm* — Workman Nydegger

(57) ABSTRACT

A liquid ejecting apparatus includes a liquid ejecting head that ejects a liquid from a plurality of nozzles disposed in a nozzle surface, a wiping member that wipes the nozzle surface, and a wiping member moving mechanism that moves the wiping member between a wiping position where the nozzle surface is wiped and a retracted position. The wiping member moving mechanism has a wiping member holding mechanism that holds the wiping member and a holding state releasing mechanism that releases a holding state of the wiping member holding mechanism in a case where a load that is equal to or higher than a set value is received.

12 Claims, 19 Drawing Sheets

(56) References Cited

U.S. PATENT DOCUMENTS

| | | | |
|---|---|---|---|
| 2006/0232625 | A1 | 10/2006 | Takeda |
| 2008/0024550 | A1 | 1/2008 | Miyazawa |
| 2013/0016158 | A1 | 1/2013 | Ikeda |

FOREIGN PATENT DOCUMENTS

| | | | |
|---|---|---|---|
| JP | 2003-019810 | A | 1/2003 |
| JP | 2003-205620 | A | 7/2003 |
| JP | 2003-266721 | A | 9/2003 |
| JP | 2004-299311 | A | 10/2004 |
| JP | 206-272779 | A | 10/2006 |
| JP | 2007-090715 | A | 4/2007 |
| JP | 2007-301984 | A | 11/2007 |
| JP | 2013-018172 | A | 1/2013 |

* cited by examiner

LIQUID EJECTING APPARATUS AND MAINTENANCE DEVICE

BACKGROUND

1. Technical Field

The present invention relates to a liquid ejecting apparatus that ejects a liquid, such as an ink, and a maintenance device.

2. Related Art

For example, an ink jet printing apparatus including a transporting device that transports a medium such as paper and a liquid ejecting head that ejects a liquid such as an ink onto the transported medium is known as this type of liquid ejecting apparatus. This type of liquid ejecting apparatus has a maintenance device that performs maintenance of the liquid ejecting head in order to prevent and clear clogging of nozzles of the liquid ejecting head. The maintenance device includes a cap unit having a cap that covers the nozzle surface to which the nozzles of the liquid ejecting head are opened and a wiping device (wiper unit) having a wiper that wipes the nozzle surface of the liquid ejecting head.

For example, the liquid ejecting apparatus disclosed in JP-A-2003-19810 includes a wiping and rubbing unit for head cleaning having a rubbing member and a wiping member, which are provided on a base. The wiping and rubbing unit moves the rubbing member and the wiping member along a guide surface provided on the base by the revolving of a cleaner driving lever by a drive source. Consequently, the rubbing member and the wiping member are movable forward/backward in a direction perpendicular to a direction along a moving path of the liquid ejecting head (recording head).

However, in the maintenance device of the liquid ejecting apparatus disclosed in JP-A-2003-19810, there are irregular cases where the liquid ejecting head or a medium is positioned in a movement region of the wiping member (the rubbing member and the wiping member). In this case, there is a possibility that the wiping member comes into contact with the liquid ejecting head or a medium and the wiping member or other members become damaged. In addition, there is a possibility that wiping operation is not performed well in a case where a relative position between the liquid ejecting head and the wiping member in a direction intersecting the nozzle surface is changed. In some cases, maintenance operation by the maintenance device is not performed well in a case where using conditions during maintenance of the liquid ejecting head are changed, such as the irregular position of the liquid ejecting head and a change in the relative position between the liquid ejecting head and the wiping member.

SUMMARY

An advantage of some aspects of the invention is to provide a liquid ejecting apparatus and a maintenance device that can perform maintenance operation of a liquid ejecting head well also in a case where using conditions of the liquid ejecting head are changed.

According to an aspect of the invention, there is provided a liquid ejecting apparatus including a liquid ejecting head that ejects a liquid from a plurality of nozzles disposed in a nozzle surface, a wiping member that wipes the nozzle surface, and a wiping member moving mechanism that moves the wiping member between a wiping position where the nozzle surface is wiped and a retracted position separated away from the wiping position. The wiping member moving mechanism has a wiping member holding mechanism that holds the wiping member, a driving force transmitting unit that receives a driving force from a drive source and moves the wiping member holding mechanism, and a holding state releasing mechanism that releases a holding state of the wiping member holding mechanism in a case where a load that is equal to or higher than a set value is received.

According to this configuration, the occurrence of damage to the wiping member or other members caused by the wiping member coming into contact with the liquid ejecting head or the medium can be reduced in an irregular case where the liquid ejecting head or the medium is positioned in a movement region of the wiping member. Therefore, the maintenance operation of the liquid ejecting head can be performed well also in a case where using conditions of the liquid ejecting head are changed.

In the liquid ejecting apparatus, it is preferable that the wiping member be moved to a wiping position where the wiping member can come into contact with the nozzle surface while moving from the retracted position separated away from the nozzle surface to the wiping position in an orthogonal direction, which is orthogonal to the nozzle surface.

According to this configuration, the wiping member moving mechanism can be suitably adopted as the moving mechanism of the wiping member. That is, in an irregular case where the liquid ejecting head or the medium is positioned in the movement region of the wiping member, a shock occurred when the wiping member comes into contact with the liquid ejecting head or the medium while moving can be reduced since the retracted position is separated away from the nozzle surface in the orthogonal direction.

In the liquid ejecting apparatus, it is preferable that a position of the wiping member during wiping include a second wiping position closer to the retracted position than the wiping position in the orthogonal direction that is orthogonal to the nozzle surface, as a position between the wiping position and the retracted position in the forward/backward direction.

According to this configuration, the position of the wiping member to be disposed can be selected from the plurality of wiping positions including the wiping position and the second wiping position by moving the wiping member in the forward/backward direction. Even in a case where the position of the liquid ejecting head is changed in order to change an interval between the liquid ejecting head and the medium, an overlapping amount (interference amount) of the wiping member and the nozzle surface can be kept appropriately. In addition, the overlapping amount of the wiping member and the nozzle surface in the orthogonal direction can be changed. Therefore, the nozzle surface can be appropriately wiped by the wiping member.

In the liquid ejecting apparatus, it is preferable that the wiping member holding mechanism have a holding member that is guided by a guide portion extending in the forward/backward direction, that holds the wiping member, and that is movable in a rising/falling direction intersecting the nozzle surface, and a slide member that holds the holding member so as to be movable in the rising/falling direction and that is connected to the driving force transmitting unit.

According to this configuration, as the slide member connected to the driving force transmitting unit moves in the forward/backward direction, the holding member is guided by the guide portion and moves in the rising/falling direction with respect to the slide member. Therefore, this configuration can be suitably adopted as the wiping member holding mechanism that causes movement through which the wiping member is displaced in the forward/backward direction and the rising/falling direction.

In the liquid ejecting apparatus, it is preferable that the holding state releasing mechanism have a locking part that is provided in the driving force transmitting unit and engageably locks in a locked part provided in the slide member and a locked member, which is used as the locked part held by the slide member so as to be movable from a locking position of being engageably locked in the locking part to a non-locking position of not being engageably locked in a case where a load that is equal to or higher than the set value is received while the wiping member moves from the retracted position to the wiping position.

According to this configuration, when a load that is equal to or higher than the set value is received while the wiping member moves from the retracted position to the wiping position, the locked member moves from the locking position, at which the locked member is engageably locked in the locking part, to the non-locking position, at which the locked member is not engageably locked in the locking part. As a result, the holding state of the slide member with respect to the driving force transmitting unit is released and the driving force transmitting unit moves with respect to the wiping member and the slide member. Therefore, this configuration can be suitably adopted as a configuration of the holding state releasing mechanism.

In the liquid ejecting apparatus, it is preferable to further include an absorbing member provided at a position where the absorbing member comes into contact with a surface of the wiping member, which is at the retracted position, on a forward traveling side of the wiping direction.

According to this configuration, the liquid adhered to the wiping member can be removed. In addition, the wiping surface of the wiping member can be cleaned by movement between the retracted position and the wiping position of the wiping member.

In the liquid ejecting apparatus, it is preferable that the driving force transmitting unit have a rack that receives a driving force from the drive source and meshes with a gear fixed to an end portion of a rotation shaft rotating about an axis, which extends along the nozzle surface and intersects the forward/backward direction.

According to this configuration, the rack can be suitably adopted as a configuration for moving the driving force transmitting unit in the forward/backward direction.

In the liquid ejecting apparatus, it is preferable to further include a cap that is connected to a rotating cam which is fixed to a second rotation shaft rotating about an axis along the axis of the rotation shaft so as to be movable between a capping position at which a space including the nozzles is formed by abutting against the nozzle surface and a non-capping position separated away from the nozzle surface.

According to this configuration, the cap can be suitably adopted as a configuration of maintaining the liquid ejecting head, and the wiping member and the cap can be efficiently moved.

In the liquid ejecting apparatus, it is preferable to further include a biasing member biasing the cap in a direction from the non-capping position to the capping position, a revolving member revolving between a first revolving posture in which the cap is disposed at the non-capping position and a second revolving posture in which the cap is disposed at the capping position, and a cam follower provided in the revolving member in a state of being engaged with the rotating cam. It is preferable that the rotating cam have a cam unit that causes the revolving member to revolve in the first revolving posture by being engaged with the cam follower, and allow the revolving member to be disposed in the second revolving posture, in which the cap is disposed at the capping position by a biasing force of the biasing member, at a rotation angle where engagement of the cam unit with the cam follower is released.

According to this configuration, the configuration can be suitably adopted as a configuration of maintaining the liquid ejecting head, and the wiping member and the cap can be efficiently moved.

In the liquid ejecting apparatus, it is preferable that the cam follower have a rotating body that is engageable with the cam unit of the rotating cam, the cam unit have at least one engaged portion that is engageable with the rotating body when the rotating cam is at a rotation stop position, and at least one engaged portion, out of the engaged portions, have a recessed portion that is engageable with the rotating body.

According to this configuration, the rotating cam is positioned at the regular rotation stop position by the rotating body of the cam follower being pressed by the recessed portion of the cam unit, even when the rotation stop position of the rotating cam varies. Therefore, the cap can be disposed at the non-capping position with relatively high position accuracy.

In the liquid ejecting apparatus, it is preferable to further include, in a case where the rotating cam is used as a first rotating cam, a second rotating cam that rotates with the rotation shaft and a pressing lever that moves between a set position where the revolving member is held in the first revolving posture and a reset position where revolving of the revolving member from the first revolving posture to the second revolving posture is allowed, according to rotation of the second rotating cam.

According to this configuration, when the pressing lever is disposed at the set position according to the rotation of the second rotating cam, the revolving member is held in the first revolving posture. When the pressing lever is disposed at the reset position, the revolving member revolves from the first revolving posture to the second revolving posture. Therefore, the first rotating cam (rotating cam) can dispose the cap at the non-capping position even at a rotation angle where the revolving member is in the second revolving posture in which the cap is disposed at the capping position.

According to another aspect of the invention, there is provided a maintenance device including a wiping member that wipes the nozzle surface of a liquid ejecting head which ejects a liquid from a plurality of nozzles disposed in the nozzle surface and a wiping member moving mechanism that moves the wiping member between a wiping position where the nozzle surface is wiped and a retracted position separated away from the wiping position. The wiping member moving mechanism has a wiping member holding mechanism that holds the wiping member, a driving force transmitting unit that receives a driving force from a drive source and moves the wiping member holding mechanism, and a holding state releasing mechanism that releases a holding state of the wiping member holding mechanism in a case where a load that is equal to or higher than a set value is received. According to this configuration, the same operation effects as the effects of the liquid ejecting apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
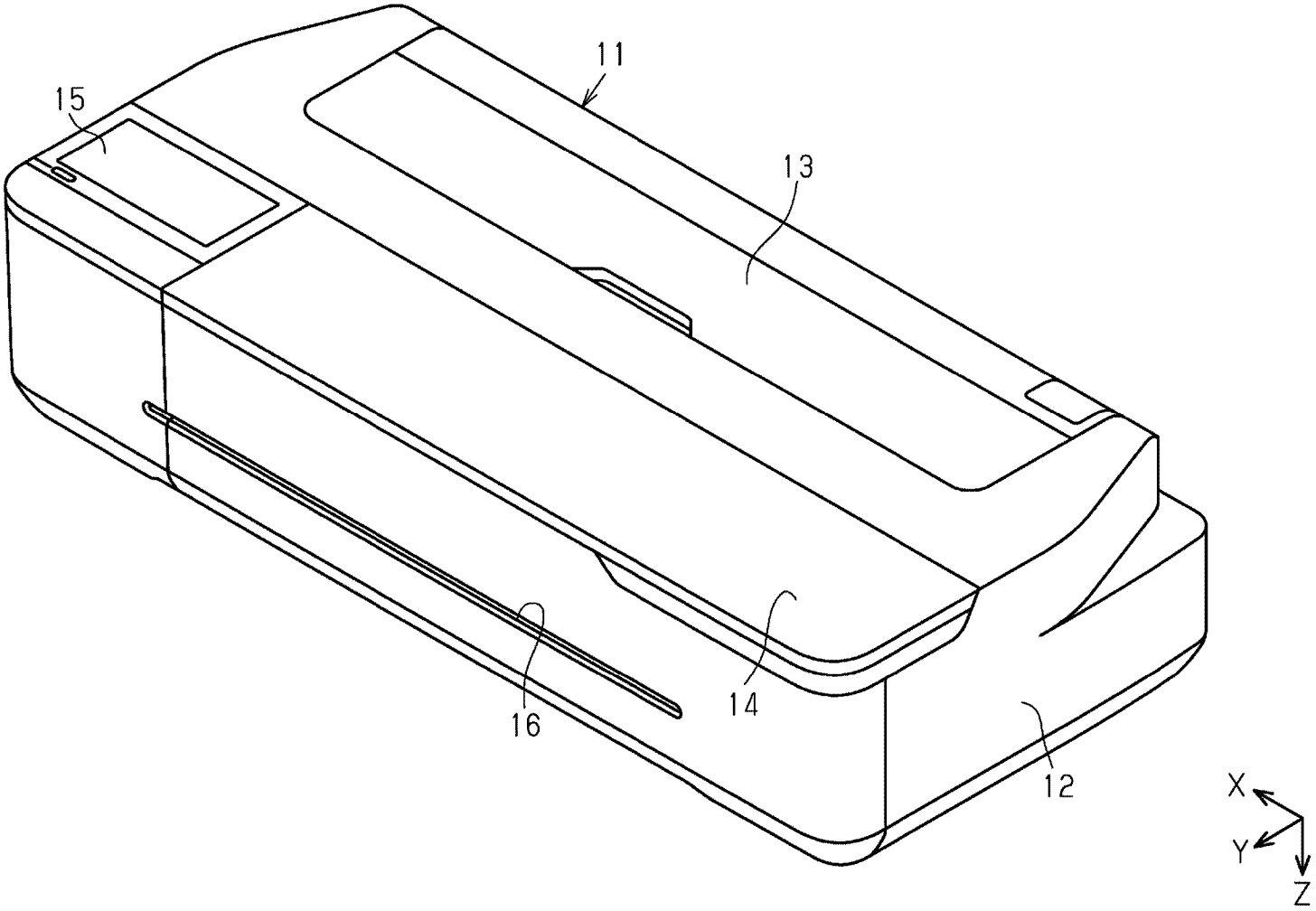
FIG. 1 is a perspective view illustrating a liquid ejecting apparatus of one embodiment.

Hereinafter, an embodiment of a liquid ejecting apparatus will be described with reference to the drawings. The liquid ejecting apparatus is, for example, an ink jet printing apparatus (printer) that ejects a liquid such as an ink to print onto a medium M such as paper. In the description below, on the assumption that a liquid ejecting apparatus 11 illustrated in FIG. 1 is placed on a horizontal plane, a direction along an upward direction to a downward direction is shown as a vertical direction Z and directions along the horizontal plane are shown as a width direction X and a transporting direction Y. That is, the width direction X, the transporting direction Y, and the vertical direction Z are directions which are different from each other and intersect (preferably, are orthogonal to) each other. In addition, one end side in the transporting direction Y is referred to as a front side, and the other end side is referred to as a rear side.

As illustrated in FIG. 1, the liquid ejecting apparatus 11 includes a substantially rectangular parallelepiped case 12. The case 12 includes, on an upper surface portion thereof, a first cover 13 (paper feed cover) positioned on the rear side and a second cover 14 (maintenance cover) positioned on the front side in a state of being openable/closable.

An operation panel 15, which is operated in order to give various types of instructions to the liquid ejecting apparatus 11, is provided on a front end portion of an upper surface of the case 12. The operation panel 15 is, for example, a touch panel and can display and input various types of information. An exit port 16, through which the medium M such as printed paper exits, is provided in a front surface of the case 12.

Figure 2:
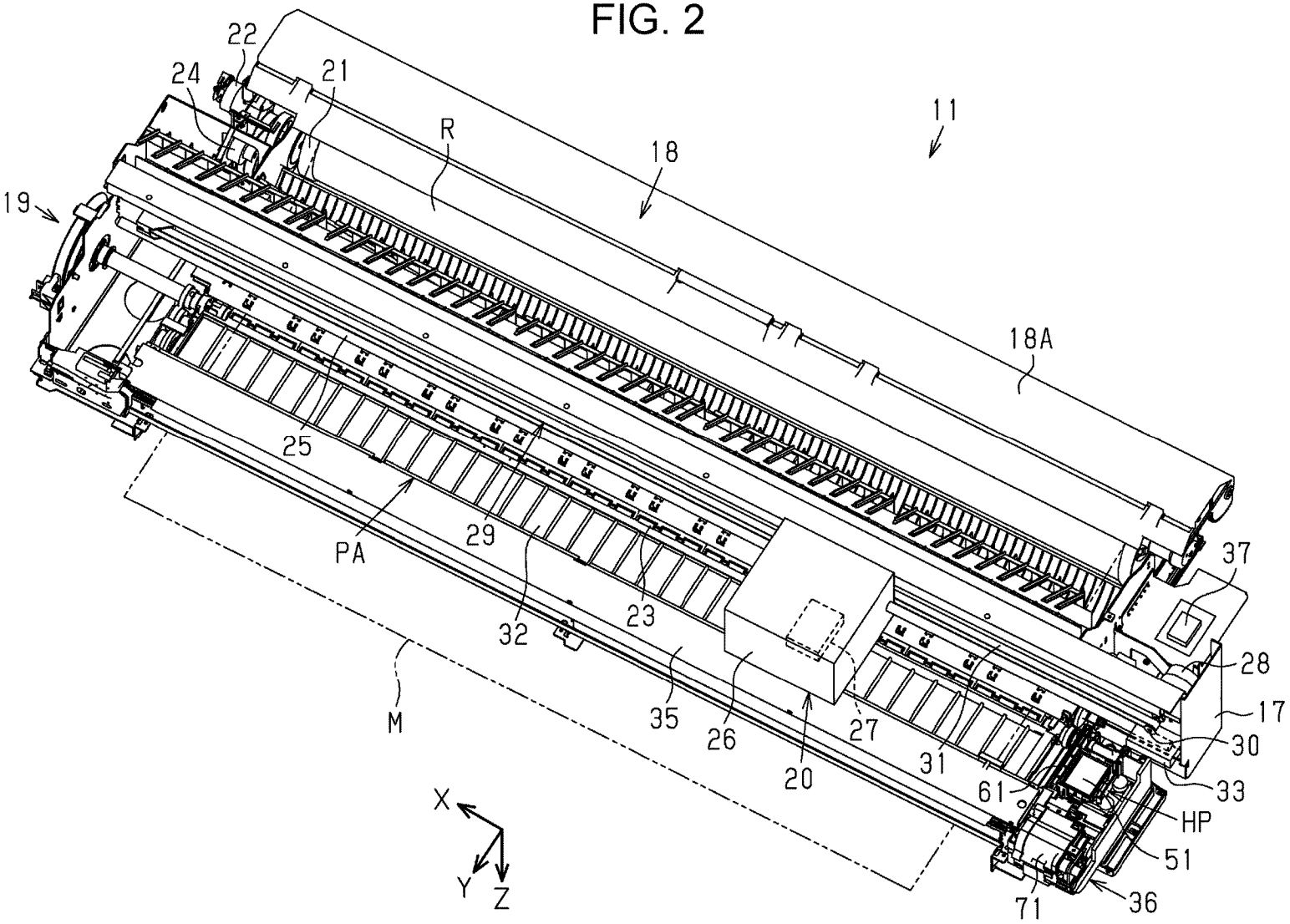
FIG. 2 is a perspective view illustrating an internal configuration of the liquid ejecting apparatus.

Next, an internal configuration of the liquid ejecting apparatus 11 will be described with reference to FIG. 2. FIG. 2 illustrates a state where the case 12 of the liquid ejecting apparatus 11 is removed. As illustrated in FIG. 2, the liquid ejecting apparatus 11 includes a frame 17 having a predetermined shape inside thereof. The liquid ejecting apparatus 11 includes a feeding unit 18 that feeds the medium M, a transporting unit 19 that transports the medium M from the feeding unit 18, and a printing unit 20 that prints onto the transported medium M. For example, a roll feed system in which the medium M is reeled out and fed from a roll R, around which the unused medium M is wound in a cylindrical shape, is adopted for the feeding unit 18 in an example of FIG. 2. The feeding unit 18 includes a rotation supporting mechanism 21 that can rotatably support the roll R. A transporting motor 22, which is a drive source of the rotation supporting mechanism 21, is joined to one end portion of the frame 17 in the width direction X (left end portion in FIG. 2). A guide cover 18A that covers the accommodated roll R from above is provided in a state of being openable/closable at an inward position corresponding to the first cover 13 (refer to FIG. 1).

The feeding unit 18 illustrated in FIG. 2 rotates the roll R set in the rotation supporting mechanism 21 in one direction (reeling out direction) by the transporting motor 22 being driven. The medium M reeled out by the rotation of the roll R is fed to the printing unit 20 on a downstream side of the transporting direction Y. When the first cover 13 illustrated in FIG. 1 is opened, the feeding unit 18 is exposed to the outside, and when the guide cover 18A illustrated in FIG. 2 is also opened, it is possible to set or replace the roll R. Without being limited to the roll feed system, a cassette feed system or a tray feed system may be adopted for the feeding unit 18.

The transporting unit 19 illustrated in FIG. 2 includes a pair of transporting rollers 23 that rotates in a state of pinching the medium M. In the example, the pair of transporting rollers 23 rotates by motive power transmitted from the transporting motor 22 via a train wheel 24. A region where the medium M is transported by the transporting unit 19 in the width direction X is referred to as a transporting region, and the medium M is transported within the transporting region regardless of the width thereof. The transporting unit 19 may be a belt type transporting mechanism without being limited to a roller type transporting mechanism.

The printing unit 20 illustrated in FIG. 2 includes a guide shaft 25 that stretches along the width direction X (hereinafter, also referred to as a "main scanning direction X") and a carriage 26 that is guided by the guide shaft 25 and is supported so as to be movable in the main scanning direction X. The carriage 26 has a liquid ejecting head 27 at a place (in the example, a lower portion) opposing a transporting path of the medium M. The liquid ejecting head 27 ejects a liquid from a plurality of nozzles 272 (all refer to FIG. 18) disposed in a nozzle surface 271 (for example, a lower surface) opposing the transporting path of the medium M. The liquid ejecting head 27 of the example is a piezoelectric ink jet head having an actuator (not illustrated), such as a piezoelectric element, for each of the nozzles 272. The liquid ejecting head 27 may be a thermal head or an electrostatic head without being limited to the piezoelectric head.

The printing unit 20 includes a carriage motor 28 which is a drive source causing the carriage 26 to reciprocate in the main scanning direction X. The carriage 26 and the carriage motor 28 are connected to each other such that motive power can be transmitted via a moving mechanism 29. In an example illustrated in FIG. 2, the moving mechanism 29 includes a pair of pulleys 30 and an endless timing belt 31 on which the pair of pulleys 30 hangs. When the carriage motor 28 of which an output shaft is connected to one pulley 30 (on the right in FIG. 2) is forward/reverse-rotation driven, the carriage 26 fixed to a part of the timing belt 31 reciprocates in the main scanning direction X. The moving mechanism 29 may be a known linear motion mechanism such as a ball screw mechanism without being limited to a belt type moving mechanism.

As illustrated in FIG. 2, a support base 32 having a long plate shape stretching in the width direction X is disposed at a position opposing (below) a moving path of the liquid ejecting head 27 during printing. The support base 32 supports the transported medium M and defines an interval (gap) between the liquid ejecting head 27 and the medium M. In addition, the maximum region that the liquid ejecting head 27 can print in the width direction X is a printing region PA.

As illustrated in FIG. 2, the liquid ejecting apparatus 11 has a gap adjusting mechanism 33 that can adjust an interval (gap) between the liquid ejecting head 27 and the support base 32. In the example illustrated in FIG. 2, the gap adjusting mechanism 33 is provided at an end position (right end position in FIG. 2) of the frame 17, which is on the outside of the printing region PA in the width direction X. The gap adjusting mechanism 33 adjusts the gap between the liquid ejecting head 27 and the support base 32 according to a medium type by rising/falling of the guide shaft 25 supporting the carriage 26 or changing of the height of the carriage 26 with respect to the guide shaft 25.

A so-called on-carriage type or off-carriage type is adopted for a liquid supply system illustrated in FIG. 2, in which a liquid (for example, an ink) is supplied to the liquid ejecting head 27. In the on-carriage type, a liquid accommodating body (for example, an ink cartridge) is provided in a state of being attachable/detachable to the carriage 26 and a liquid is supplied from the liquid accommodating body to the liquid ejecting head 27. On the contrary, in the off-carriage type, a liquid accommodating body is attachably/detachably loaded in a cartridge holder (not illustrated) attached to the frame 17, and a liquid is supplied from the liquid accommodating body to the liquid ejecting head 27 through a tube (not illustrated).

As illustrated in FIG. 2, a cutting unit 35 (cutter unit) that can cut the long printed medium M so as to have a designated length in the transporting direction Y is provided at a position on the downstream side of the support base 32 in the transporting direction Y. The cutting unit 35 has a movable blade which is movable in the width direction X and a long fixed blade (not illustrated) which is longer than the width of the medium M, and cuts the medium M as the movable blade moves along the fixed blade.

As illustrated in FIG. 2, a position next to (to the right in FIG. 2) the printing region PA in the width direction X is a home position HP where the carriage 26 that has not performed printing stands by. A maintenance device 36 is disposed at a position opposing the carriage 26 when the carriage is at the home position HP. The maintenance device 36 performs maintenance of a liquid supply system including the liquid ejecting head 27, and prevents and clears clogging of, for example, the nozzles 272 of the liquid ejecting head 27.

As illustrated in FIG. 2, the maintenance device 36 includes a cap 51, a wiper 61, which is an example of a wiping member, and an electric motor 71, which is an example of a drive source. The maintenance device 36 performs maintenance on the liquid ejecting head 27 in a state where the carriage 26 is positioned at a maintenance position (for example, the home position HP) where the liquid ejecting head 27 and the cap 51 oppose each other. Clogging of the nozzles 272 is prevented by the cap 51 rising and covering the nozzle surface 271 of the liquid ejecting head 27. The maintenance device 36 makes a space, which is surrounded by the nozzle surface 271 and the cap 51 and communicates with the nozzles 272, be at negative pressure by the suction-discharge of air to perform cleaning, which is forcibly suction-discharging a liquid from the nozzles 272. In addition, the maintenance device 36 wipes the nozzle surface 271 by relatively moving the wiper 61, which is in a state of being in contact with the nozzle surface 271, with respect to the liquid ejecting head 27 in a wiping direction at a predetermined time such as cleaning termination. In this example, the wiper 61 wipes the nozzle surface 271 by the carriage 26 moving in the main scanning direction X in a state where the wiper 61 is at a wiping position, which is higher above a retracted position.

As illustrated in FIG. 2, the liquid ejecting apparatus 11 has a control unit 37 attached to an end portion (right end portion in FIG. 2) of the frame 17. The control unit 37 is configured of, for example, a chip which is provided in a substrate and includes a central processing unit (CPU), an application specific IC (ASIC), and a nonvolatile memory. The control unit 37 controls the driving of the transporting motor 22, the carriage motor 28, the liquid ejecting head 27, and the electric motor 71 and controls the feeding unit 18, the transporting unit 19, the printing unit 20, the gap adjusting mechanism 33, the cutting unit 35, and the maintenance device 36. The liquid ejecting apparatus 11 prints a character or an image onto the medium M by repeating printing operation, in which the liquid ejecting head 27 ejects a liquid (for example, an ink) from the nozzles 272 onto the medium M while the carriage 26 moves in the main scanning direction X, and transporting operation in which the medium M is transported to the next printing position (print line).

Figure 3:
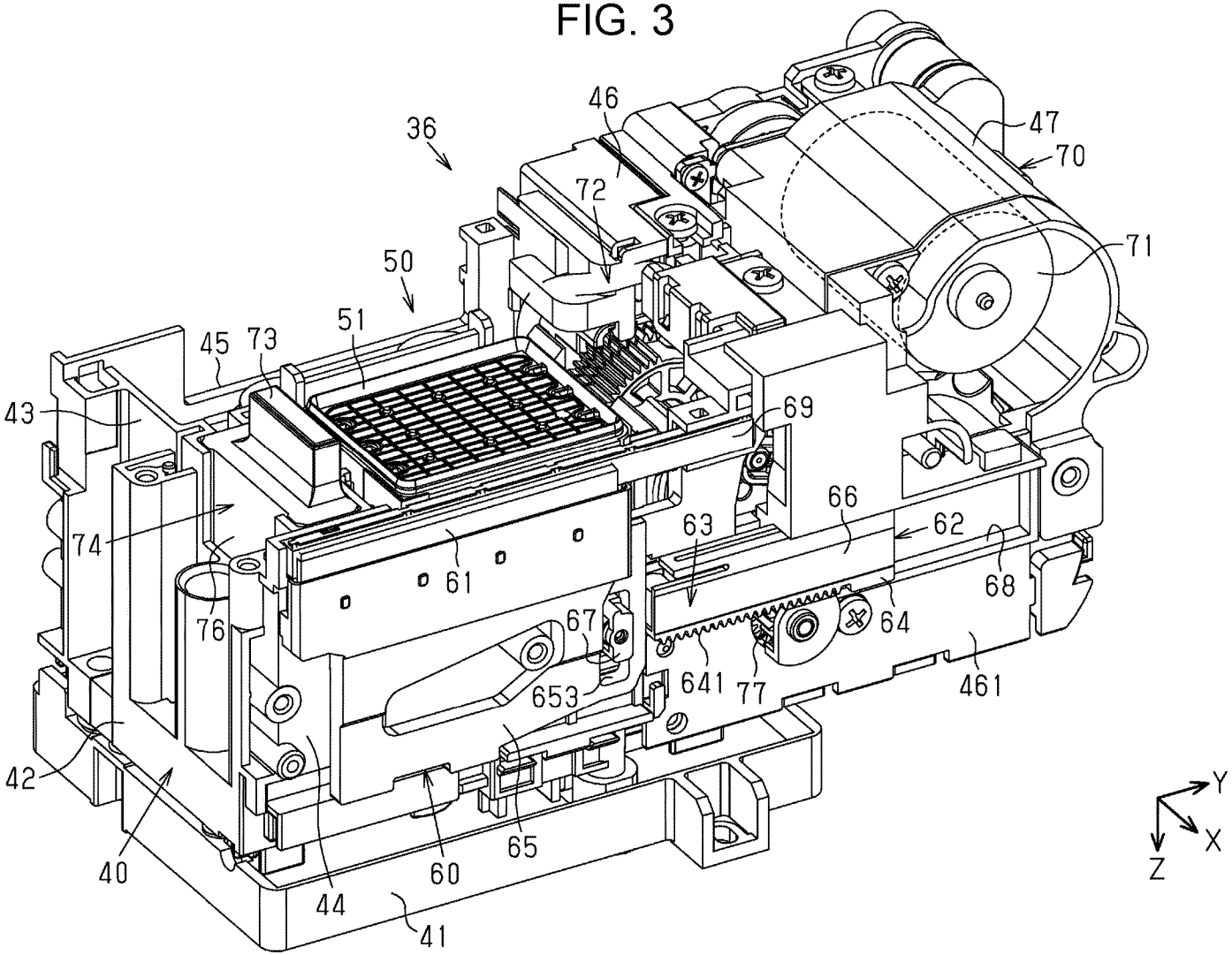
FIG. 3 is a perspective view illustrating a maintenance device.

Next, a detailed configuration of the maintenance device 36 will be described with reference to FIGS. 3 to 29. As illustrated in FIG. 3, the maintenance device 36 includes a cap unit 50 having the cap 51, a wiper unit 60 having the wiper 61, and a driving mechanism 70 having the electric motor 71 and a motive power transmitting mechanism 72. The maintenance device 36 further includes a lock unit 74, which has a lock member 73, and a suction pump 75 (refer to FIG. 4). The electric motor 71 is the drive source of the maintenance device 36. The motive power transmitting mechanism 72 selectively transmits the motive power of the electric motor 71 to the cap unit 50, the wiper unit 60, the lock unit 74, and the suction pump 75 to drive the aforementioned units at a predetermined timing. The motive power transmitting mechanism 72 includes a cam mechanism, and the cap 51, the wiper 61, the lock member 73, the suction pump 75, and an atmospheric release valve 78 (refer to FIG. 28) are driven at a predetermined timing by the selection of a cam configuring the cam mechanism. The suction pump 75 functions as a suction flow generation source that generates a suction flow to suck a fluid (gas and liquid) within the cap 51.

As illustrated in FIG. 3, the maintenance device 36 includes a base unit 40 to which each of the units 50, 60, and 74, the suction pump 75, and the driving mechanism 70 is joined. The base unit 40 has a dish-shaped waste liquid accommodating unit 41 (waste liquid tank) that stores a waste liquid (for example, a waste ink) from the cap 51. The base unit 40 further includes a substantially square plate-shaped base portion 42 disposed above the waste liquid accommodating unit 41, a back plate portion 43 that stands at a rear portion (left portion in FIG. 3) of the base portion 42, and a pair of side plate portions 44 and 45 opposing each other in the width direction X. The pair of side plate portions 44 and 45 is disposed on both sides of the base unit 40 sandwiching a region where the cap unit 50 is disposed in the width direction X (right-and-left direction).

In addition, the base unit 40 has a housing portion 46 to which the driving mechanism 70 is joined. In particular, the electric motor 71 is accommodated in a motor housing portion 47 which configures a part of the housing portion 46. The maintenance device 36 is disposed at the home position HP in the example of FIG. 2 by fixing the base unit 40 to the frame 17 (refer to FIG. 2) with the use of a screw (not illustrated). The base unit 40 of the embodiment is configured such that a layout, in which the cap unit 50 and the wiper unit 60 are joined to the base unit 40, can be selected. Details of a configuration where layouts of the units 50 and 60, which are joining targets of the base unit 40, can be selected will be described later.

Figure 20:
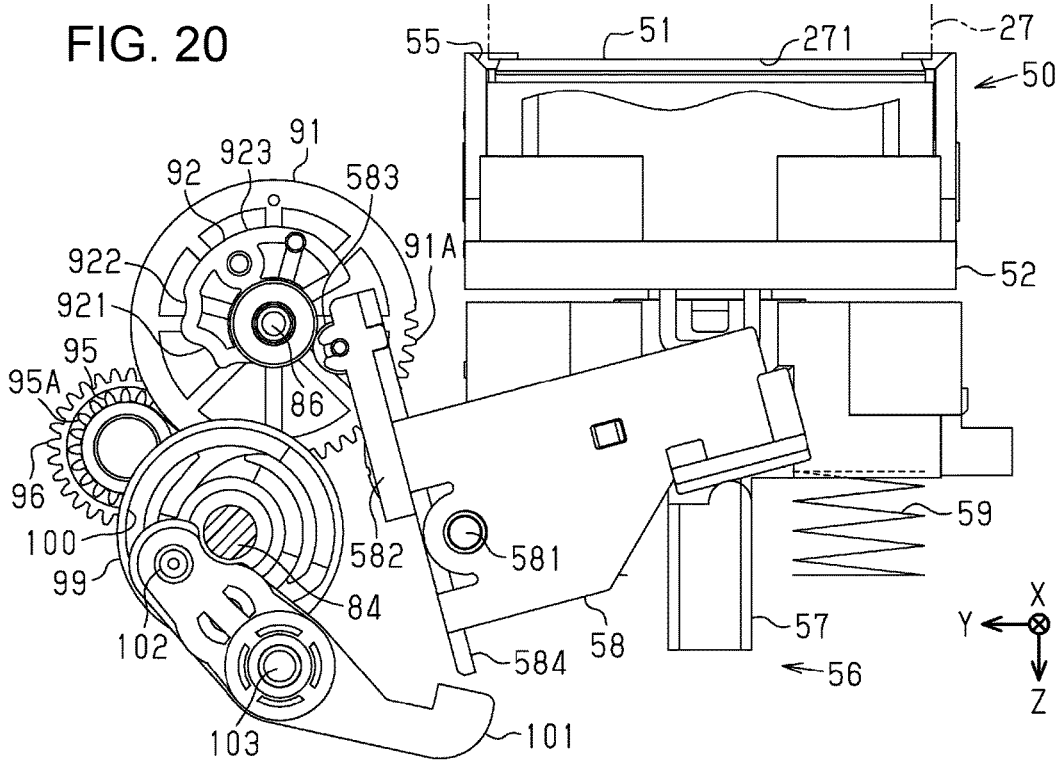
FIG. 20 is a side view illustrating the cap unit which is in a state where the cap is at a closed position.

By a driving force transmitted from the electric motor 71 via the motive power transmitting mechanism 72, the cap 51 illustrated in FIG. 3 rises and falls between a non-capping position illustrated in FIG. 3 and a capping position, at which the cap abuts against the nozzle surface 271 and which is illustrated in FIG. 20.

Figure 4:
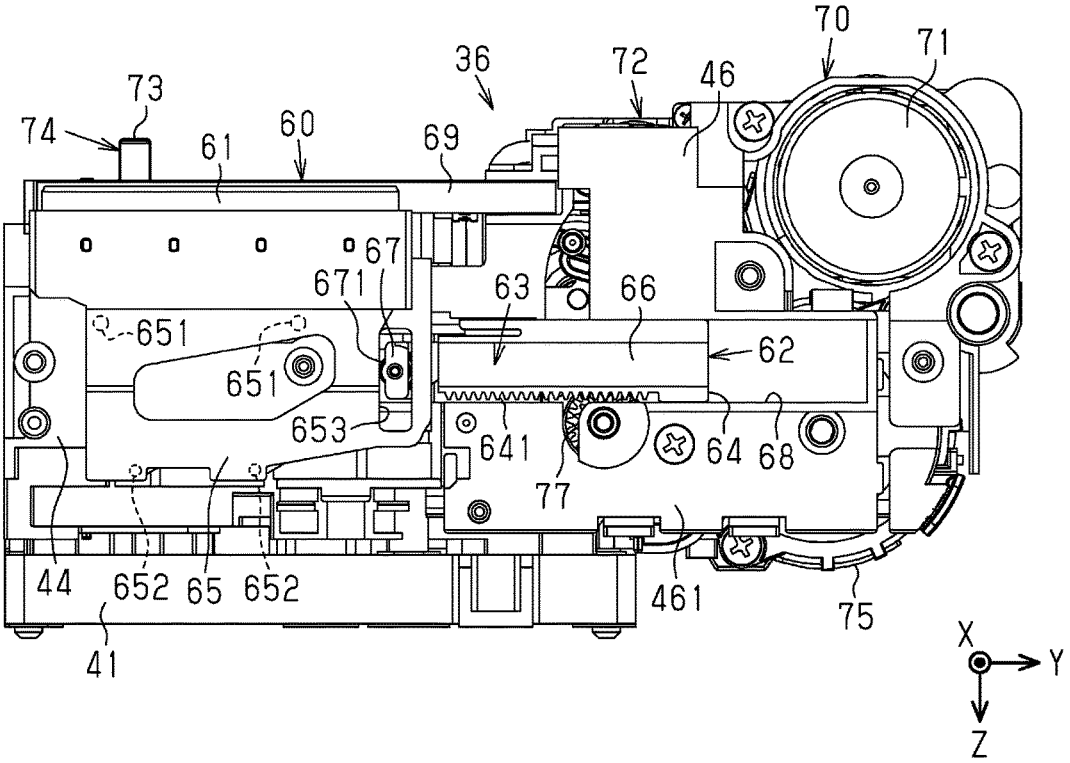
FIG. 4 is a side view illustrating the maintenance device.
Figure 5:
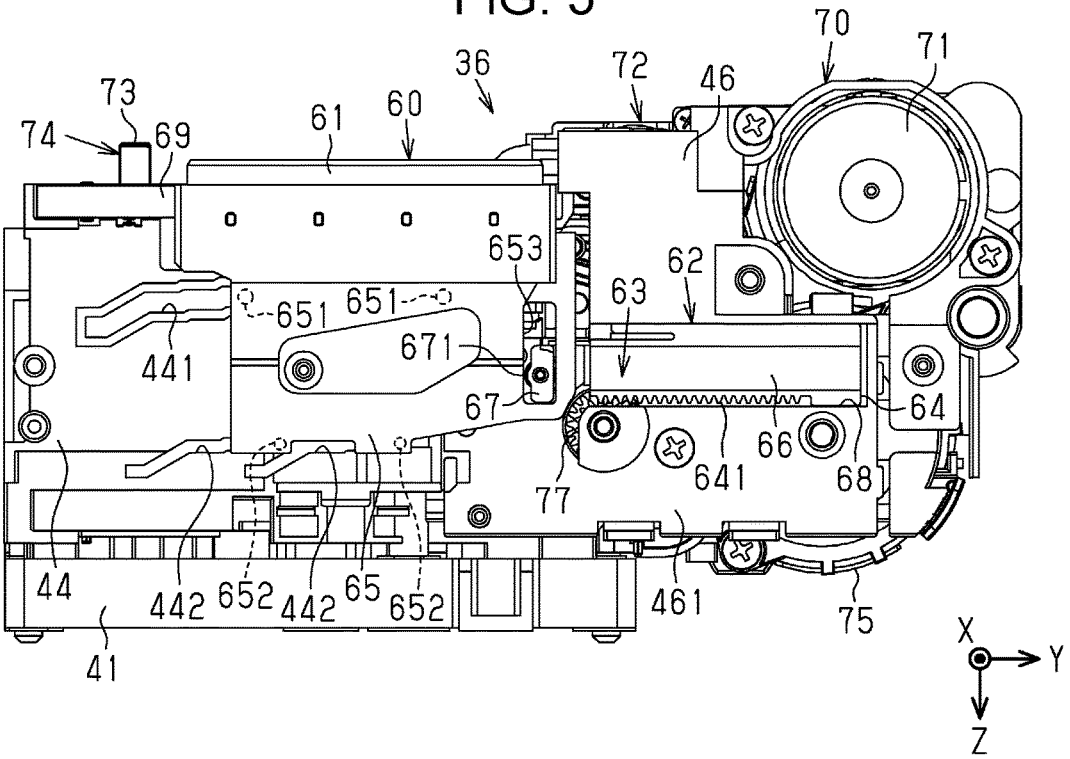
FIG. 5 is a side view illustrating the maintenance device which is in a state where a wiper is at a wiping position.

The suction pump 75 illustrated in FIGS. 4 and 5 is configured of, for example, a tube pump. Two tubes for suction and non-suction run from the suction pump 75, one end of the tube for suction is connected to the cap 51, and one end of the tube for non-suction is connected to the waste liquid accommodating unit 41. A fluid (gas and liquid) within the cap 51 is sucked by driving the suction pump 75. When the suction pump 75 is driven in a state where the cap 51 abuts against the liquid ejecting head 27, cleaning in which a liquid is forcibly suction-discharged from the nozzles 272 (refer to FIG. 18) is performed. The suction pump 75 may be a gear pump or a diaphragm type pump without being limited to the tube pump.

In addition, the cap 51 is connected to the atmospheric release valve 78 which is formed of an on/off valve that allows a space therein to communicate with the atmosphere even in a state of being abutting on the nozzle surface 271. The atmospheric release valve 78 is closed during cleaning and is opened after cleaning termination. By opening the atmospheric release valve 78, the inside of the cap 51 is opened to the atmosphere. When the suction pump 75 is continued to be driven in the atmospheric open state, a liquid is not sucked from the nozzles 272 even when the cap 51 is in a capping state and empty suction of discharging only a liquid stagnating within the cap 51 is possible.

As illustrated in FIG. 3, the lock unit 74 is disposed at a position on a side opposite to the driving mechanism 70 with the cap 51 being interposed therebetween in the transporting direction Y (depth direction). The lock unit 74 has a guide portion 76 and the lock member 73, which is guided by the guide portion 76 and can rise/fall. The lock member 73 can rise/fall between a lock released position, at which the lock member cannot engage with the carriage 26 and which is illustrated in FIG. 3, and a locked position, at which the lock member can engage with the carriage 26 when the liquid ejecting head 27 is at a position opposing the cap 51. The power source of the lock unit 74 is also the electric motor 71, and the lock member 73 rises/falls between the lock released position and the locked position at a predetermined timing. The lock member 73 restricts, at the locked position, the carriage 26 to the maintenance position (for example, the home position HP).

As illustrated in FIG. 3, the wiper 61 configuring the wiper unit 60 is disposed at a position next to the printing region PA (refer to FIG. 2) with respect to the cap 51. The wiper 61 is made of an elastic material such as synthetic rubber in a long strip-like plate shape longer than the width of the nozzle surface 271 (refer to FIG. 19) in a direction (transporting direction Y) intersecting the wiping direction (main scanning direction X), and a tip portion thereof is as thin as the thickness of a tip. The wiper unit 60 includes a wiper moving mechanism 62 as an example of a wiping member moving mechanism that moves the wiper 61 in a forward/backward direction MD between the wiping position, at which the nozzle surface 271 is wiped and which is illustrated in FIG. 5, and the retracted position, which is separated away from the wiping position in a direction along the nozzle surface 271 and is illustrated in FIGS. 3 and 4.

As illustrated in FIGS. 3 to 5, the wiper moving mechanism 62 includes a wiper holding mechanism 63, which is an example of a wiping member holding mechanism that holds the wiper 61, and a rack member 64, which is an example of a driving force transmitting unit. The wiper holding mechanism 63 has a wiper holder 65, which is an example of a holding member, and a slide member 66. That is, the wiper holder 65 holds the wiper 61 and is movable in a rising/falling direction intersecting the nozzle surface 271 (refer to FIG. 18) by being guided by guide holes 441 and 442, which are examples of a guide portion extending in the forward/backward direction MD. The slide member 66 holds the wiper holder 65 so as to be movable in the rising/falling direction and is connected to the rack member 64. The wiper 61 is held on an upper end portion of the wiper holder 65 having a plate shape, which is a predetermined shape. The wiper holder 65 has guide pins 651 and 652 that are engageably inserted in the guide holes 441 and 442 provided in a side plate portion 44. The wiper holder 65 is movable in the forward/backward direction MD and can rise/fall in the vertical direction Z by each of the guide pins 651 and 652 being guided by the guide holes 441 and 442.

The wiper holder 65 is connected to one end portion (left end portion in FIGS. 3 to 5) of the slide member 66 in the forward/backward direction MD via a connecting unit 67. The connecting unit 67 is inserted in a guide groove 653 that allows relative movement of the wiper holder 65 in the vertical direction Z. The connecting unit 67 has a roller 671 that can roll on an inner wall surface of the guide groove 653 in the vertical direction Z. When wiper holding mechanism 63 moves in the forward/backward direction MD, the wiper holder 65 relatively moves with respect to the slide member 66 in the vertical direction Z by the roller 671 rolling on the inner wall surface of the guide groove 653.

In addition, the rack member 64 receives a driving force from the electric motor 71 and moves in the forward/backward direction MD in a state of holding the wiper holding mechanism 63. A recessed guide rail 68 extending in the forward/backward direction MD is formed in a side portion of the housing portion 46. The rack member 64 is guided by the guide rail 68 and can reciprocate in the forward/backward direction MD. When the rack member 64 moves in a first direction (forward direction) from a position illustrated in FIG. 4 to a position illustrated in FIG. 5, the wiper 61 rises. In addition, when the rack member 64 moves in a second direction (backward direction) from the position illustrated in FIG. 5 to the position illustrated in FIG. 4, the wiper 61 falls.

As illustrated in FIGS. 3 to 5, a pinion 77 (pinion gear), of which a part is exposed from the side portion of the housing portion 46, is disposed below the rack member 64. The pinion 77 is a part of the motive power transmitting mechanism 72 and rotates by a driving force of the electric motor 71. The rack member 64 has a rack 641 meshing with the pinion 77, which receives the driving force from the electric motor 71 and is fixed to an end portion of a rotation shaft 84 rotating about an axis that extends along the nozzle surface 271 and that intersects the forward/backward direction MD. The rack 641 is configured by forming cogs which can be fitted into the pinion 77 on a flat plate.

As illustrated in FIGS. 4 and 5, when the electric motor 71 is forward/reverse-rotation driven, the rotational motion of the pinion 77 is converted to the reciprocating linear motion of the rack member 64 via a rack and pinion mechanism formed of the pinion 77 and the rack 641. When the electric motor 71 is forward rotation-driven and the pinion 77 rotates forward, the slide member 66 moves forward in the first direction (right direction in FIG. 4) and the wiper 61, which is at the retracted position (lowest position) illustrated in FIGS. 3 and 4, is disposed at the wiping position (highest position) illustrated in FIG. 5. On the contrary, when the electric motor 71 is reverse rotation-driven and the pinion 77 rotates reversely, the slide member 66 moves in the second direction (left direction in FIG. 5) and the wiper 61, which is at the wiping position illustrated in FIG. 5, is disposed at the retracted position illustrated in FIGS. 3 and 4. In the embodiment, at least another one or more (for example, two) wiping position is set between the retracted position and the wiping position of the wiper 61, and the wiper 61 can be disposed at a plurality of (for example, three) wiping positions having different heights.

Figure 6:
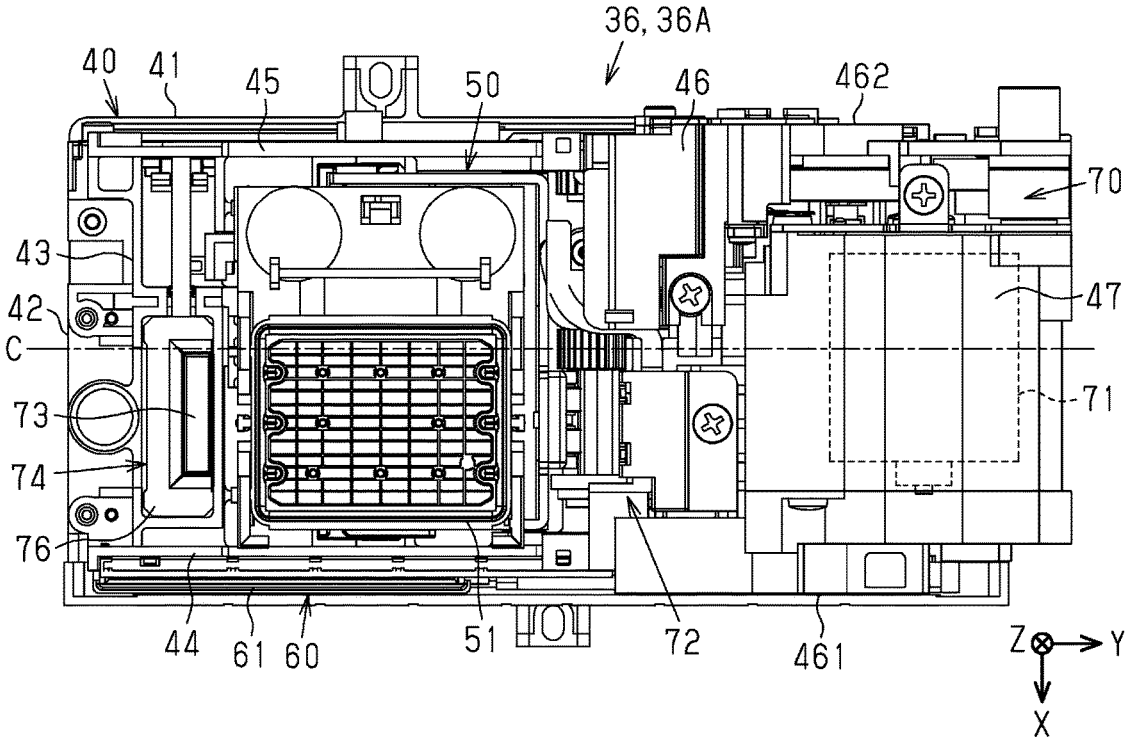
FIG. 6 is a plan view illustrating the maintenance device.
Figure 7:
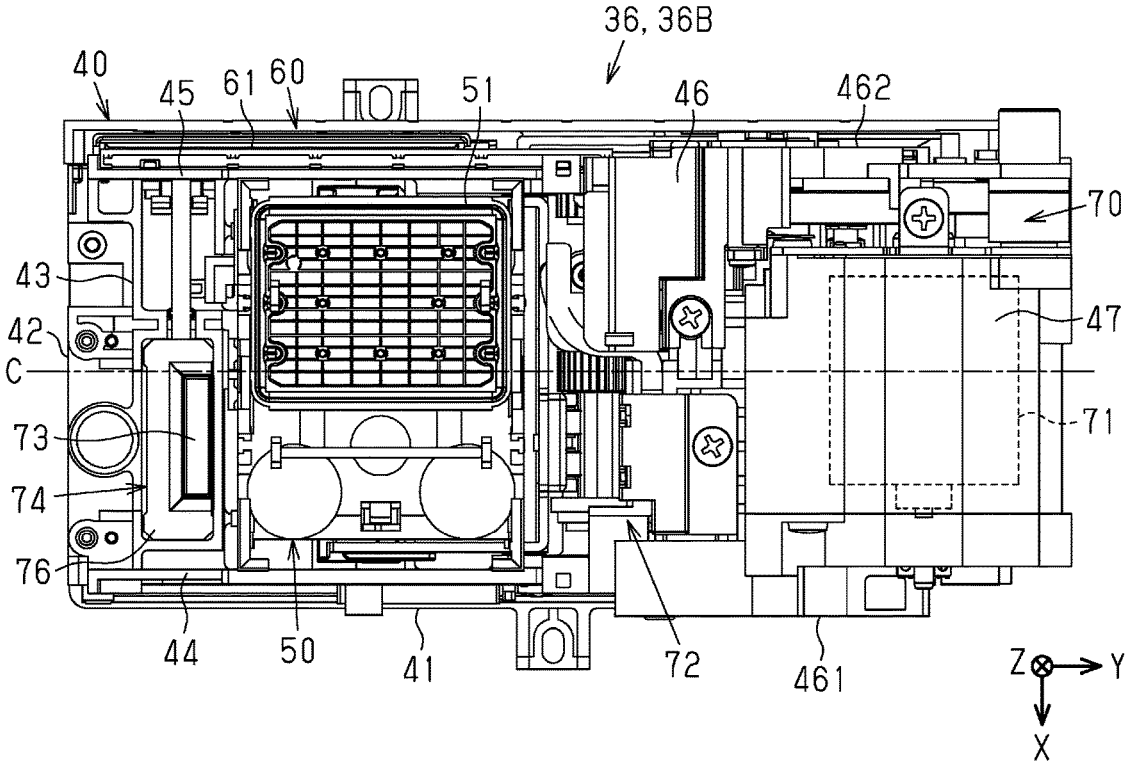
FIG. 7 is a plan view illustrating the maintenance device, which is another layout example.

FIG. 6 illustrates the maintenance device 36 (36A) of the embodiment, and FIG. 7 illustrates the maintenance device 36 (36B) in another form in which a layout is changed. In the liquid ejecting apparatus 11 illustrated in FIG. 2, a right end portion in the main scanning direction X in FIG. 2 is the home position HP, and the maintenance device 36 has a right disposition. On the other hand, in a different model of liquid ejecting apparatus, a left end portion in the main scanning direction X is a home position, and the maintenance device 36B has a left disposition. For this reason, the maintenance device 36 of the embodiment has a configuration where the base unit 40 to which each of the units 40 and 60 is joined can have both of the right disposition and the left disposition. In this manner, the base unit 40 can respond to each form of the right disposition and the left disposition by a layout of each of the units 50 and 60 being changed with the components of the electric motor 71, the motive power transmitting mechanism 72, and each of the units 50, 60, and 74 being the same.

As can be seen by comparing FIGS. 6 and 7, the cap unit 50 and the wiper unit 60 in each of FIGS. 6 and 7 are in a positional relationship that is substantially line symmetric to each other with respect to a center line C of the base unit 40. For this reason, the maintenance device 36 can have both of the right disposition (FIG. 6) and the left disposition (FIG. 7) when joined in an orientation where each of the cap and the wiper unit is rotated by 180 degrees in planar view of the common cap 51 and the wiper unit 60 in FIGS. 6 and 7.

Figure 8:
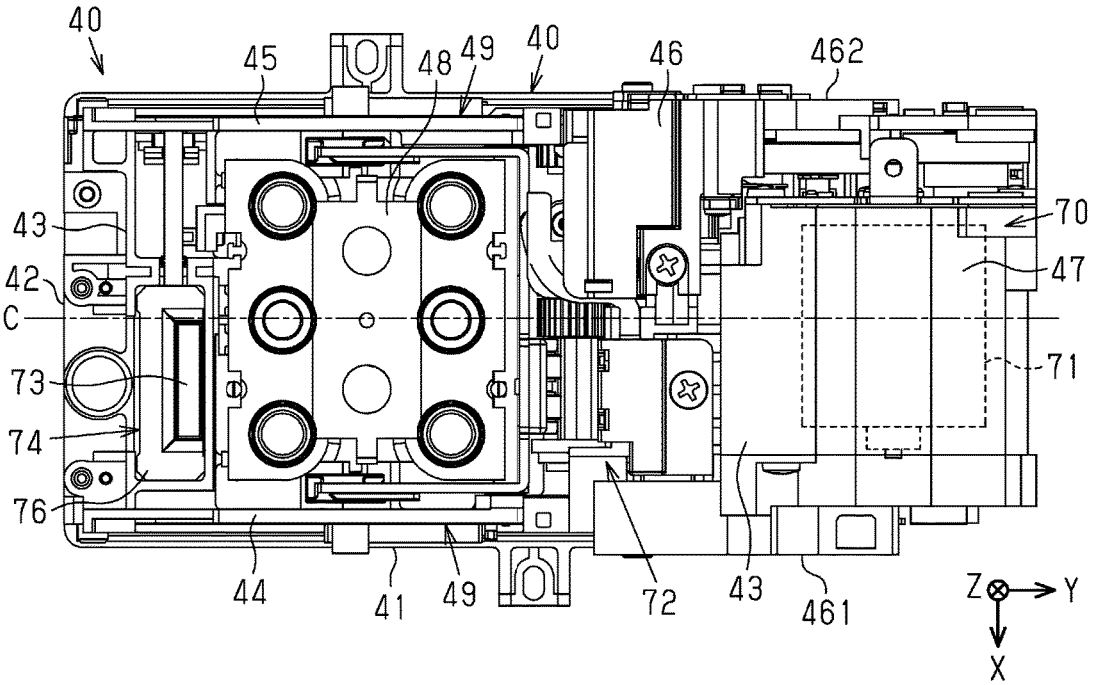
FIG. 8 is a plan view of a base unit.
Figure 9:
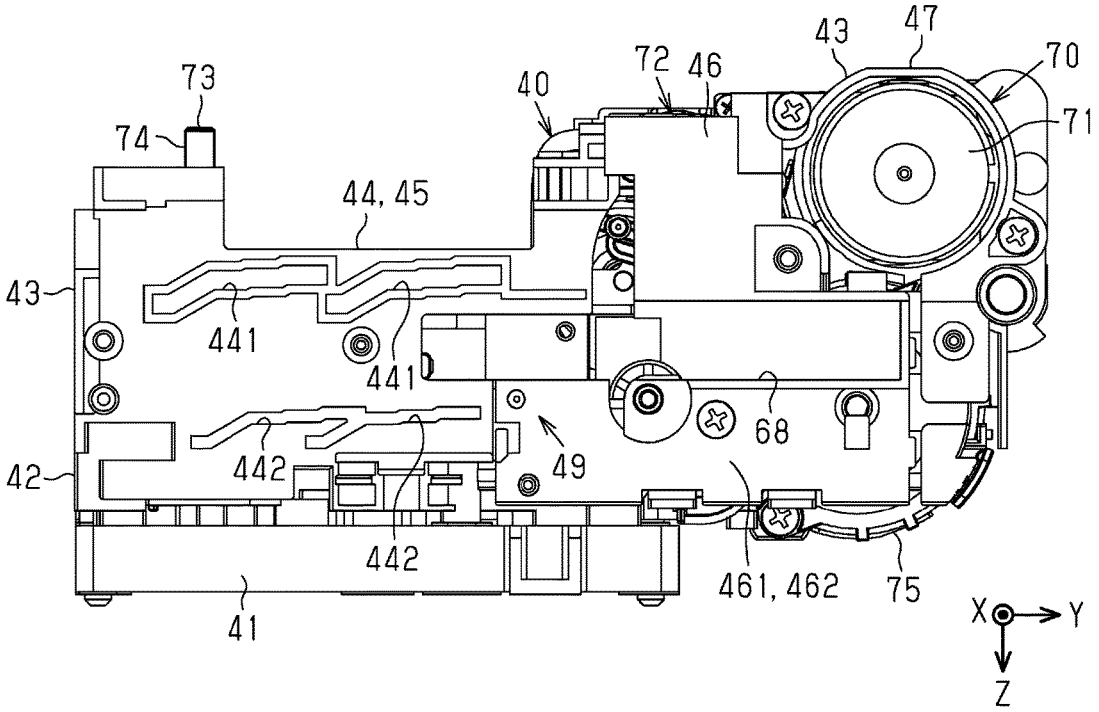
FIG. 9 is a side view of the base unit.

Next, a configuration of the base unit 40 of which a layout can be changed will be described with reference to FIGS. 8 and 9. A part of a rising/falling mechanism 56 for the electric motor 71, the motive power transmitting mechanism 72, and the cap unit 50, of which layouts are the same in the right disposition and the left disposition, are joined to the base unit 40 illustrated in FIGS. 8 and 9. In other words, FIGS. 8 and 9 shows a state of the base unit 40 before the cap 51 and the wiper unit 60, of which layouts can be changed, are joined. As illustrated in FIGS. 8 and 9, the base unit 40 includes, in a region, which is on the base portion 42 and is surrounded by the back plate portion 43 and the pair of side plate portions 44 and 45, a cap joining and holding unit 48 that can join and hold the cap 51 such that the cap can rise/fall. The cap joining and holding unit 48 has a line symmetric shape with respect to the center line C of the base portion 42. In addition, the cap joining and holding unit 48 has a shape that allows the cap 51 to be joined in two different orientations where the cap is rotated by 180 degrees in planar view illustrated in FIG. 8.

In addition, the base unit 40 is configured of the pair of side plate portions 44 and 45 and a pair of side plate portions 461 and 462 configuring the housing portion 46, and includes a wiper joining and holding unit 49 that can join and hold the wiper unit 60. The pair of side plate portions 44 and 45 and the pair of side plate portions 461 and 462 have a line symmetric shape with respect to the center line C in which each counterpart opposes each other in the width direction X and forms a pair. As illustrated in FIG. 9, two guide holes 441 extending in the forward/backward direction MD at the same height in an upper tier and two guide holes 442 extending in the forward/backward direction MD at the same height in a lower tier are formed in the pair of side plate portions 44 and 45. The four guide holes 441 and 442 opened to the pair of side plate portions 44 and 45 have a plane symmetric shape with respect to a vertical plane passing through the center line C.

The wiper holder 65 is displaced in both directions of the forward/backward direction MD and the vertical direction Z by the four guide pins 651 and 652 (refer to FIG. 4), which jut out from a back surface of the wiper holder 65, being engageably inserted into the four guide holes 441 and 442 respectively. For this reason, the wiper holder 65 can be joined in any form of the right disposition illustrated in FIG. 6 and the left disposition illustrated in FIG. 7. In addition, the aforementioned recessed guide rail 68 is formed at a position and in a shape such that each of the pair of side plate portions 461 and 462 is plane symmetric to each other with respect to the vertical plane passing through the center line C. For this reason, the rack member 64 holding the slide member 66 can be joined in any one of forms illustrated in FIGS. 6 and 7.

Figure 10:
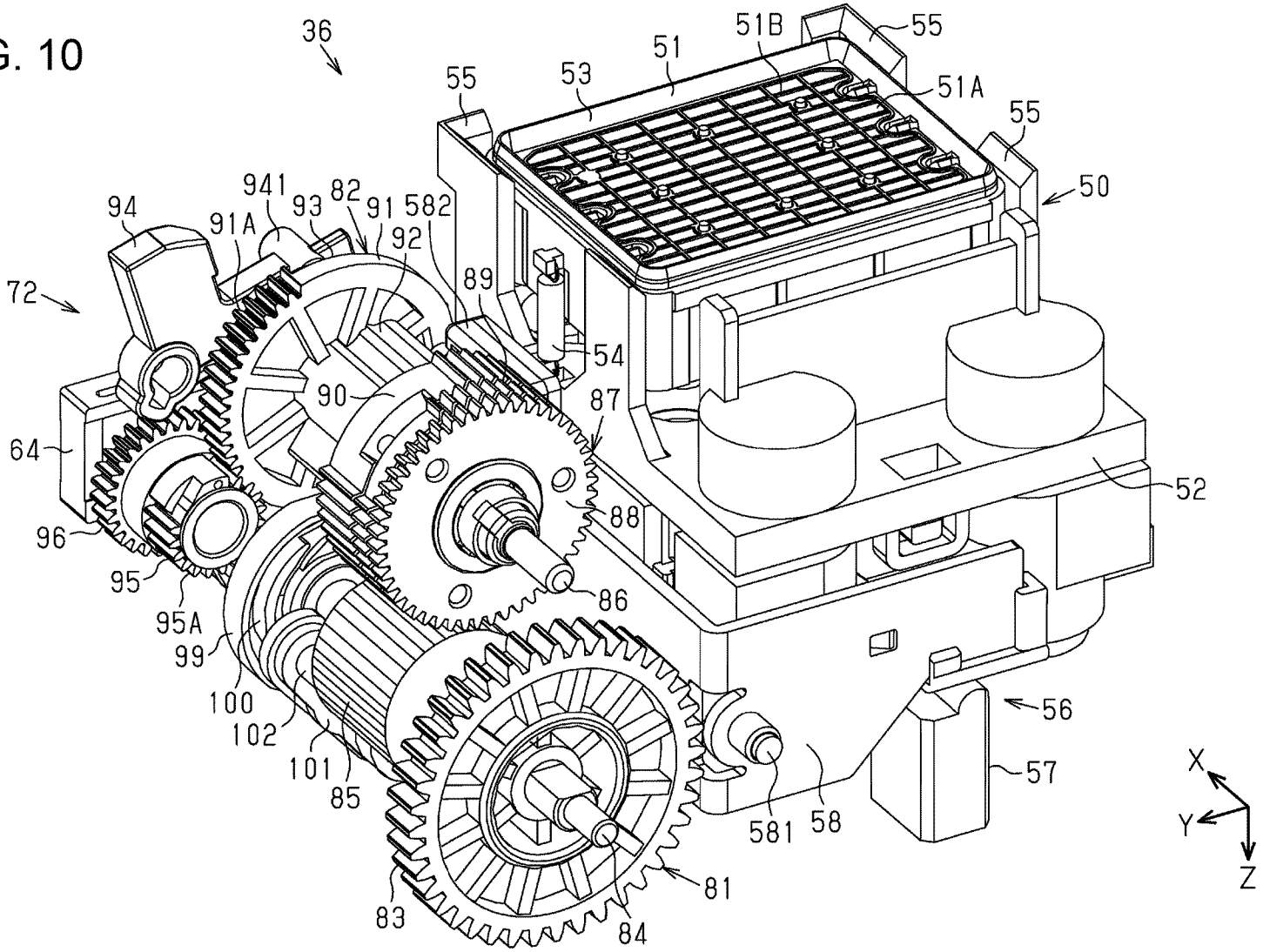
FIG. 10 is a perspective view illustrating a cap unit and a motive power transmitting mechanism.
Figure 11:
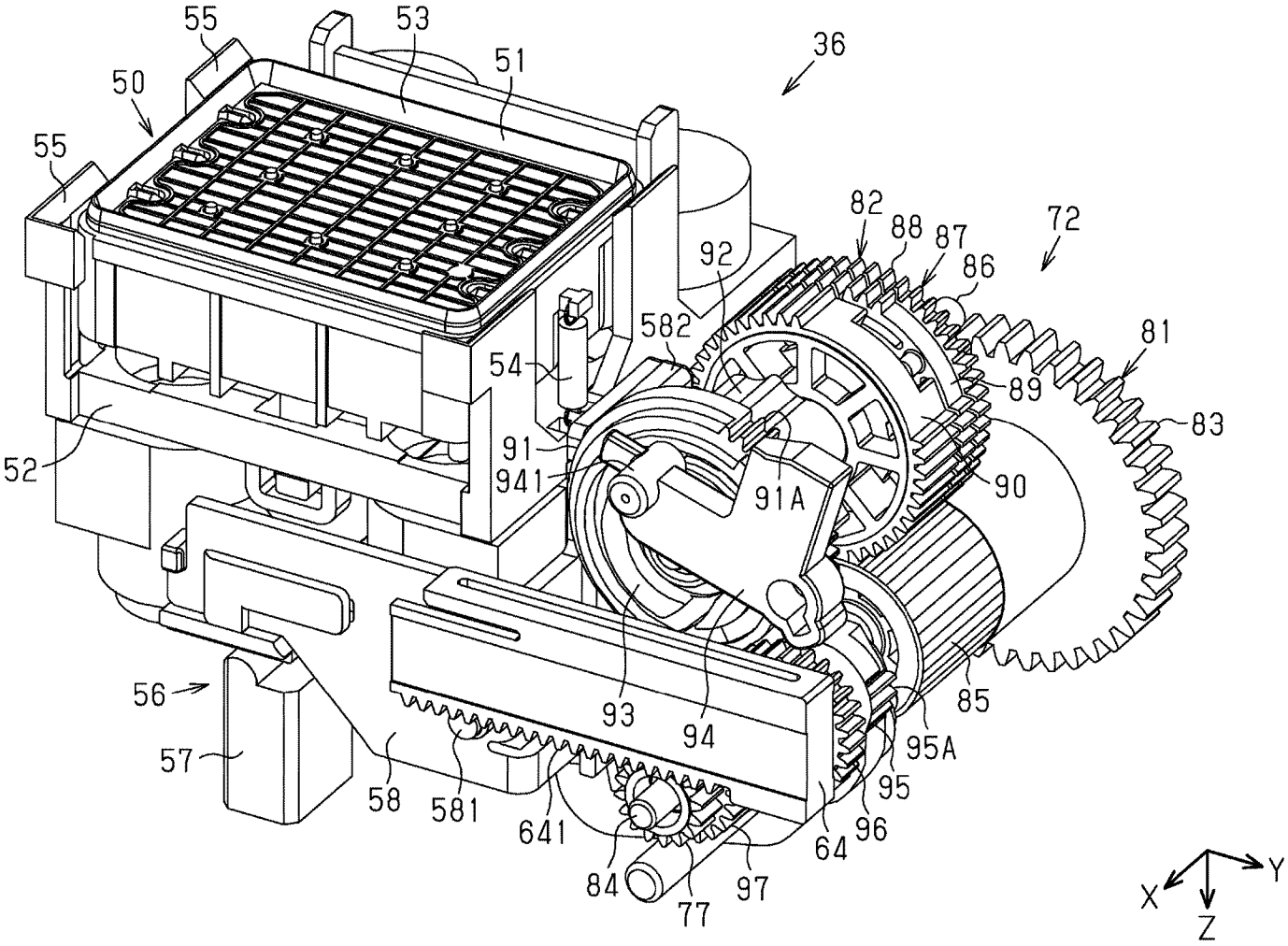
FIG. 11 is the same perspective view seen in a direction different from FIG. 10.

Next, the cap unit 50 and the motive power transmitting mechanism 72 will be described in detail with reference to FIGS. 10 and 11. As illustrated in FIGS. 10 and 11, the cap 51 has a substantially square box shape of which an upper side is opened, and is held on an upper surface of the cap holder 52. The cap 51 has a substantially square ring-shaped seal portion 53 (sealing wall) along the fringe of an upper opening thereof. The seal portion 53 is made of, for example, a synthetic resin material having rubber elasticity such as an elastomer.

The cap 51 is held at a predetermined height in a state of being elastically displaceable in the vertical direction Z by a first spring (not illustrated) formed of a compression spring biasing in a direction of separating the cap 51 away from the cap holder 52 disposed below the cap and a second spring 54 formed of a tension spring hangs between the cap 51 and the cap holder 52. For example, when the cap 51 has risen, the cap abuts against the nozzle surface 271 in a state of being pressed by a biasing force of the second spring 54.

A liquid absorbing member 51A made of a porous resin material, such as a sponge, and a reticular mesh member 51B disposed above the liquid absorbing member 51A are accommodated within the cap 51. One end of the tube stretching from the suction pump 75 (refer to FIG. 4) is connected to a pipe unit (not illustrated) protruding from a bottom portion of the cap 51. When the suction pump 75 is driven, air within the cap 51 is suction-discharged. A head guide 55 is disposed above the cap holder 52 at a position surrounding the seal portion 53 of the cap 51. The head guide 55 engages with the liquid ejecting head 27 as the cap 51 rises to the capping position and positions the cap 51 at a regular position with respect to the nozzle surface 271.

As illustrated in FIGS. 10 and 11, the rising/falling mechanism 56 that causes the cap 51 and the cap holder 52 to rise/fall is joined to a lower side of the cap holder 52. The rising/falling mechanism 56 has a rising/falling rod 57 that rises/falls in tandem with the cap holder 52 and the lock member 73 and a cap rising/falling lever 58, which is an example of a revolving member that causes the cap 51 to rise/fall. The cap rising/falling lever 58 revolves between a first revolving posture illustrated in FIGS. 10 and 11 in which the cap 51 is disposed at the non-capping position and a second revolving posture (refer to FIG. 20) in which the cap 51 is disposed at the capping position.

The cap rising/falling lever 58 illustrated in FIGS. 10 and 11 is supported so as to be revolvable around a spindle 581 within a predetermined angle range and holds a lower portion of the cap holder 52 in a state of being surrounded by both sides of the width direction X. The rising/falling mechanism 56 has a spring 59 (compression spring), which is an example of a biasing member biasing the bottom portion of the cap holder 52 in a direction (for example, the upward direction) where the cap 51 heads for the capping position from the non-capping position. By the cap rising/falling lever 58 revolving around the spindle 581, the cap 51 and the cap holder 52 reciprocate (rise/fall) in the vertical direction Z. The rising/falling rod 57 and the cap rising/falling lever 58 are driven by a driving force transmitted from the electric motor 71 illustrated in FIG. 3 via the motive power transmitting mechanism 72. When the rising/falling rod 57 rises by the revolving of the cap rising/falling lever 58, the cap 51 and the lock member 73 (refer to FIG. 3) rise at each individual timing set in advance. In the example, it is possible to lock the carriage 26 even in a state where the lock member 73 starts rising earlier than the cap 51 and the cap 51 is at the non-capping position.

Next, a detailed configuration of the motive power transmitting mechanism 72 will be described with reference to FIGS. 10 and 11. The motive power transmitting mechanism 72 illustrated in FIGS. 10 and 11 includes a cam mechanism selectively transmitting a driving force from the electric motor 71 to each of the units 50, 60, and 74 and the atmospheric release valve 78 (refer to FIG. 28). Each of the units 50, 60, and 74 and the atmospheric release valve 78 is driven at each predetermined timing by selection of a cam configuring the cam mechanism.

As illustrated in FIG. 11, the motive power transmitting mechanism 72 has a first gear train 81 in the lower tier and a second gear train 82 in the upper tier. The first gear train 81 has a drive gear 83, into which a driving force from the electric motor 71 is input and which has a long diameter, and a wide gear 85 provided on the rotation shaft 84, which is also the shaft of the drive gear 83. The second gear train 82 has a rotation shaft 86, which is an example of a second rotation shaft rotating about an axis along the axis of the rotation shaft 84. The gear 85 is fitted into a triple clutch 87 provided on the rotation shaft 86 of the second gear train 82. The clutch 87 includes one gear 88, an intermittent gear 89 that can rotate relatively and can rotate integrally with the gear 88 due to frictional connection, and an intermittent gear 90 that can rotate relatively with respect to the intermittent gear 89 in a predetermined angle range. Each of the gears 88 to 90 configuring the clutch 87 is disposed so as to oppose each other within the width range of the gear 85 and can be fitted into the gear 85. The clutch 87 has a function of initiating the rotation of the intermittent gear 90 after a predetermined time lag from the rotation initiation of the gear 88 fitted into the gear 85 when the gear 85 rotates forward or rotates reversely with the drive gear 83. After the intermittent gear 90 is fitted into the gear 85, a driving force is directly transmitted from the gear 85 to the intermittent gear 90. The intermittent gear 90 rotates in the angle range in which the intermittent gear is fitted to the gear 85. The drive gear 83 is connected to the suction pump 75 (refer to FIG. 4) such that motive power can be transmitted. When the drive gear 83 rotates reversely, the suction pump 75 is driven to suck air from the cap 51. When the drive gear 83 rotates forward, the suction pump 75 is released and the inside thereof is opened to the atmosphere.

A first rotating cam 91, which is an example of a rotating cam functioning as an intermittent gear, is fixed to the rotation shaft 86, which is also the shaft of the clutch 87. The first rotating cam 91 (hereinafter, also referred to as the "first cam 91") has a columnar cam unit 92 protruding from one side surface in an axial direction and a cam groove 93 (refer to FIG. 11) that is recessed in the other side surface. The first cam 91 is connected to the cap 51 in a state where the first cam can cause the cap 51 to rise/fall via the aforementioned cap rising/falling lever 58 driven by a cam surface forming an outer circumferential surface of the columnar cam unit 92. In addition, a cam pin 941 jutting out from a tip portion of an oscillating member 94 is engageably inserted in the cam groove 93 of the first cam 91. The oscillating member 94 revolves by the first cam 91 rotating forward/reversely and the cam pin 941 being guided along the cam groove 93 to a position close to the outer circumference of the first cam 91 and a position close to the inner circumference of the first cam. The atmospheric release valve 78 (refer to FIG. 28) opens/closes by the revolving of the oscillating member 94.

In other words, the cam groove 93 of the first cam 91 functions as a cam for opening/closing the atmospheric release valve 78, and the oscillating member 94 having the cam pin 941 functions as a cam follower.

As illustrated in FIG. 10, a teeth portion 91A of the first cam 91 can be fitted into a teeth portion 95A of an intermittent gear 95. The intermittent gear 95 rotates with a gear 96 provided on the same shaft. The gear 96 is fitted into a gear 97 provided on the rotation shaft 84 fixed to an end portion of the pinion 77 illustrated in FIG. 11. The pinion 77 is fitted into the rack 641 of the rack member 64.

As illustrated in FIG. 10, a second rotating cam 99 is fixed to the rotation shaft 84. The second rotating cam 99 (hereinafter, also referred to as the "second cam 99") has a cam groove 100 in one side surface. A cap pressing lever 101, which is an example of a pressing lever, is provided so as to be revolvable at a place of opposing the cam groove 100 of the second cam 99. A cam pin 102 jutting out from a base end portion of the cap pressing lever 101 is engageably inserted in the cam groove 100 of the second cam 99. When the second cam 99 rotates forward/reversely and the cam pin 102 moves along the cam groove 100 between a position close to the outer circumference of the second cam 99 and a position close to the inner circumference of the second cam, and the cap pressing lever 101 revolves between a reset position and a set position. When the cap pressing lever 101 is at the set position, the cap rising/falling lever 58 is disposed in the first revolving posture, in which the cap 51 can be held at the non-capping position and which is illustrated in FIG. 10. In addition, when the cap pressing lever 101 is at the reset position, the biasing of the spring 59 allows the cap rising/falling lever 58 to revolve in the second revolving posture (refer to FIG. 20), in which the cap 51 can be held at the capping position.

The drive gear 83 and the gear 85 are supported such that the gears can rotate relatively with respect to the rotation shaft 84 in a state of being integrally and rotatably connected to each other. The pinion 77, the gear 97, and the second cam 99 are fixed to the rotation shaft 84, and are integrally rotatable. For this reason, the rotation of the gear 85 is transmitted to the gear 97 via the clutch 87, the first cam 91, the intermittent gear 95, and the gear 96. A detailed configuration of the rising/falling mechanism 56 having the rising/falling rod 57, the cap rising/falling lever 58, and the cap pressing lever 101 will be described later.

Next, a detailed configuration of the wiper unit 60 will be described with reference to FIGS. 12 to 19.

Figure 12:
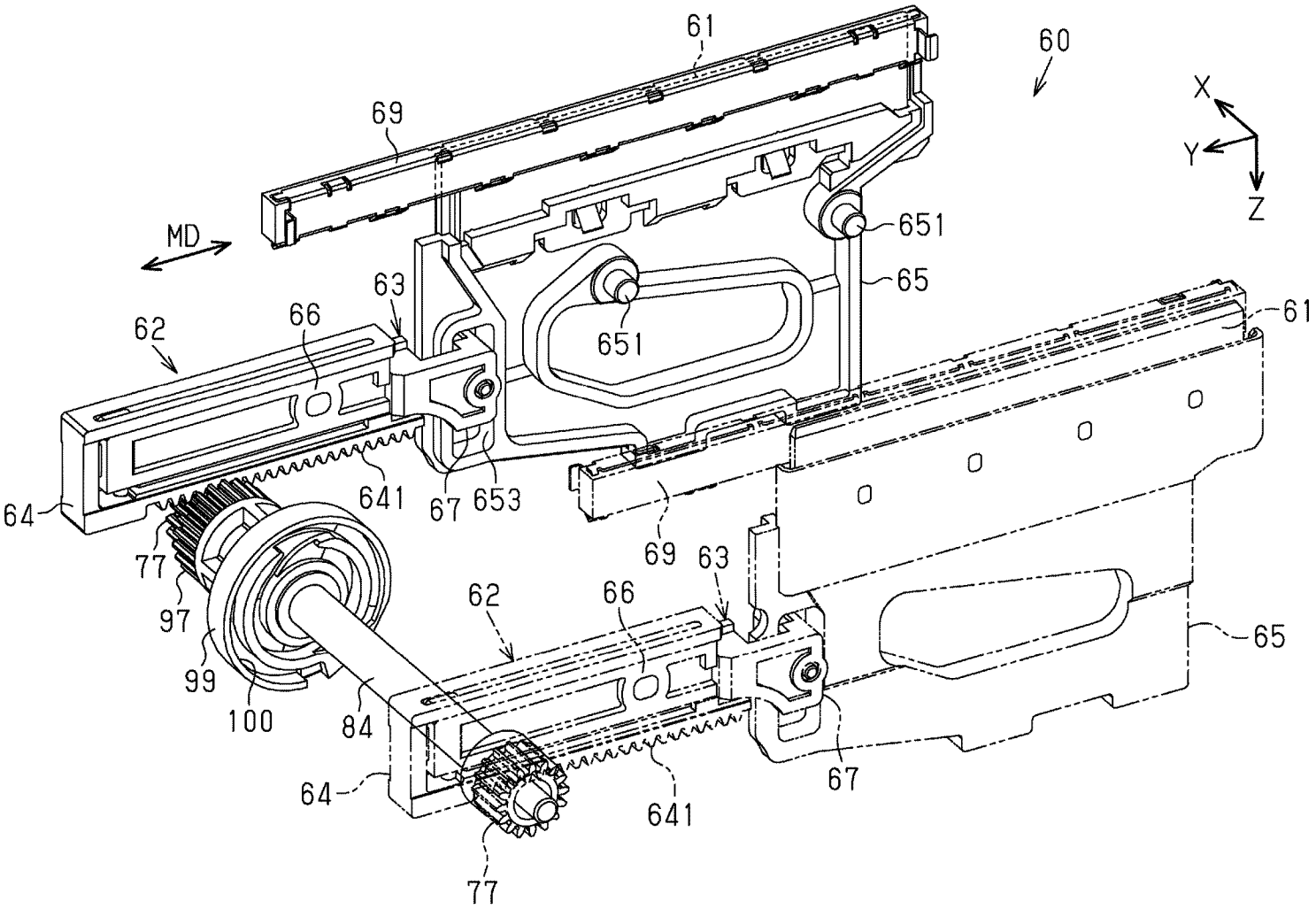
FIG. 12 is a perspective view illustrating a wiper unit.

As illustrated in FIG. 12, the wiper unit 60 is configured by joining the wiper moving mechanism 62 to one of both axial end portions of the rotation shaft 84. In an example of the maintenance device 36 (36A) having the right disposition as in the liquid ejecting apparatus 11 illustrated in FIG. 2, the wiper moving mechanism 62 is joined at a position shown with a solid line in FIG. 12. In this case, the pinion 77 is fixed to one end portion of the rotation shaft 84 as shown with a solid line in FIG. 12, and is fitted into the rack 641. On the other hand, in an example of the maintenance device 36 (36B) having the left disposition on the contrary to the liquid ejecting apparatus 11 illustrated in FIG. 2, the wiper moving mechanism 62 is joined at a position shown with a two-dot chain line in FIG. 12. In this case, the pinion 77 is fixed to the other end portion of the rotation shaft 84 as shown with a two-dot chain line in FIG. 12, and is fitted into the rack 641.

When the rack member 64 having the rack 641 fitted into the pinion 77 moves in the forward/backward direction MD by the rotation of the pinion 77, the slide member 66 held by the rack member 64 moves together in the forward/backward direction MD. The wiper holder 65 connected to a tip portion of the slide member 66 via the connecting unit 67 also moves together in the forward/backward direction MD in a state of being allowed rise/fall. The wiper holder 65 has the aforementioned two upper and lower guide pins 651 and 652 (only one is illustrated in FIG. 12) on a back surface (surface on a side opposing the side plate portion 44 in FIG. 3) thereof. When the wiper moving mechanism 62 moves in the first direction (the left in the forward/backward direction MD in FIG. 12), the guide pins 651 and 652 are guided by the guide holes 441 and 442 (FIGS. 5 and 16) and the wiper 61 and the wiper holder 65 rise from a retracted position Ws to a wiping position W. When the wiper moving mechanism 62 moves in the second direction (the right in the forward/backward direction MD in FIG. 12), the guide pins 651 and 652 are guided by the guide holes 441 and 442 (FIGS. 5 and 16) and the wiper 61 and the wiper holder 65 fall from the wiping position to the retracted position.

Figure 13:
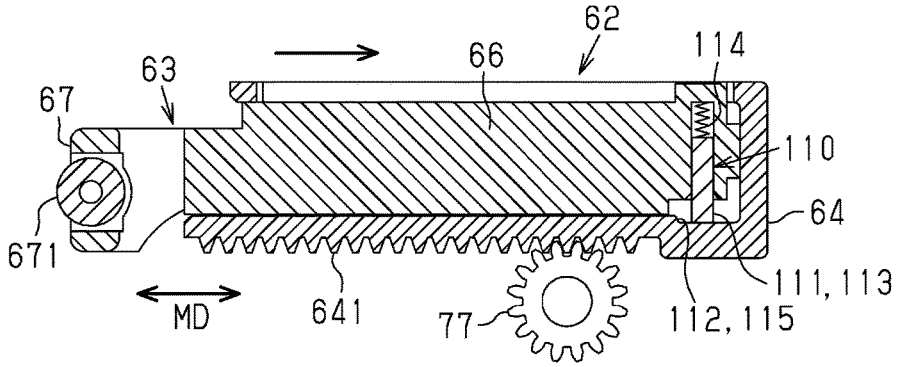
FIG. 13 is a side sectional view illustrating a part of a wiper moving mechanism.
Figure 14:
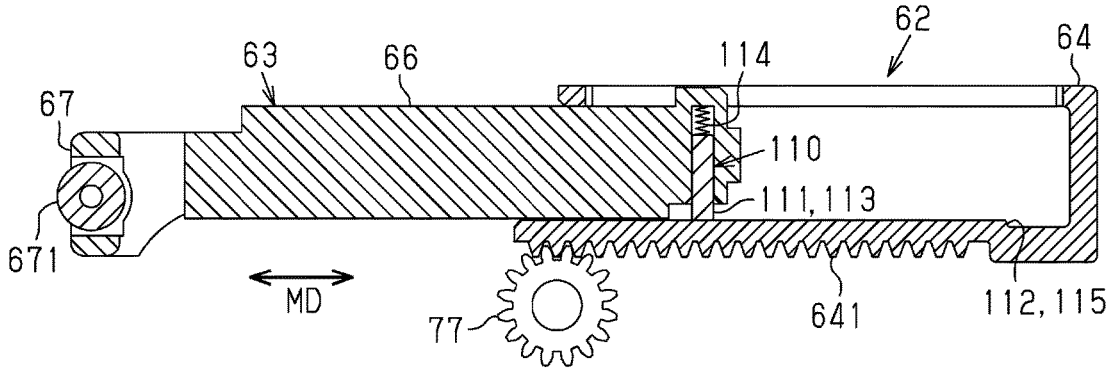
FIG. 14 is a side sectional view illustrating a part of the wiper moving mechanism which is in a holding released state.

Next, a mechanism for alleviating or clearing a shock caused when the wiper 61 hits an obstacle, including the liquid ejecting head 27 at an irregular position, as the wiper 61 rises will be described with reference to FIGS. 13 to 15. As illustrated in FIGS. 13 and 14, the wiper moving mechanism 62 includes a holding state releasing mechanism 110 that releases a holding state of the wiper holding mechanism 63 in a case where the wiper receives a load that is equal to or higher than a value set in the forward/backward direction MD (set value) while the wiper 61 moves from the retracted position to the wiping position. The wiper moving mechanism 62 including the rack member 64 that holds the wiper holding mechanism 63 moves in the first direction shown with an arrow in FIG. 13 via fitting of the pinion 77 into the rack 641 by the forward rotation driving of the electric motor 71. The first direction is a direction in which the wiper 61 is movable from the retracted position Ws to the wiping position W in the forward/backward direction MD. When a load that is equal to or higher than the set value is received in the forward/backward direction MD while the wiper moving mechanism 62 moves in the first direction, the holding state releasing mechanism 110 releases the holding state of the wiper holding mechanism 63 in which the rack member 64 holds the wiper holding mechanism. Specifically, the holding state releasing mechanism 110 before releasing connects the slide member 66 and the rack member 64 together in a state where the rack member 64 holds the slide member 66. The holding state releasing mechanism 110 of the example has a function of connecting the rack member 64 and the slide member 66 together by locking and keeps a state where the rack member 64 holds the slide member 66 by locking of both members.

Figure 15:
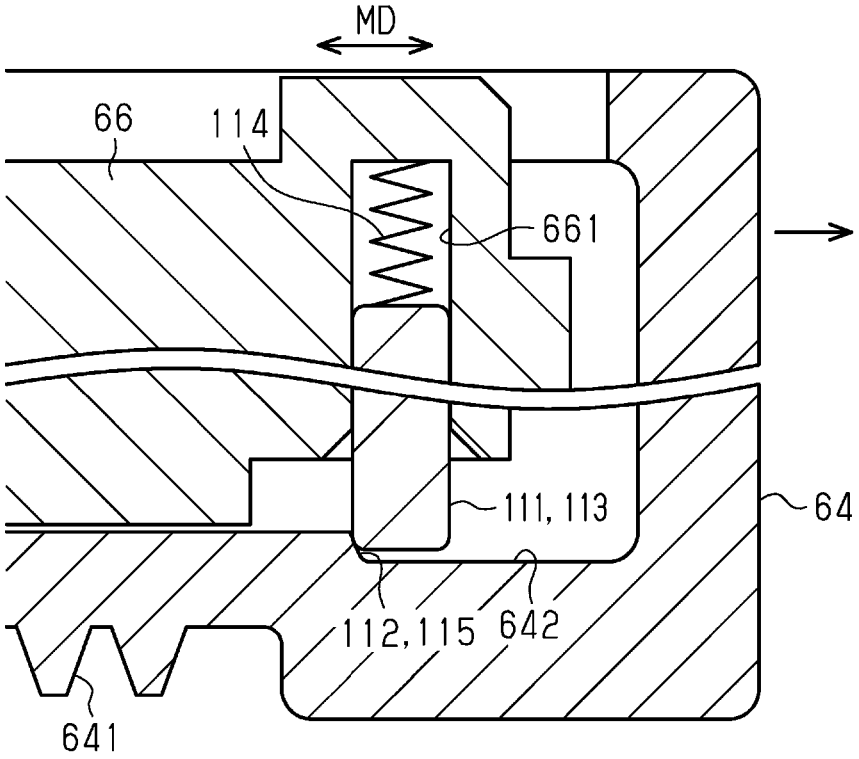
FIG. 15 is a side sectional view of main portions for illustrating operation of a holding state releasing mechanism.

As illustrated in FIGS. 13 to 15, the holding state releasing mechanism 110 has a locked part 111 provided in the slide member 66 and a locking part 112 provided in the rack member 64 in a state where the locking part can engageably lock in the locked part 111. In a case where a load that is equal to or higher than the set value is received while the wiper 61 moves from the retracted position Ws to the wiping position W, the locked part 111 is movable from a locking position, at which the locked part is engageably locked in the locking part 112 and which is illustrated in FIG. 13, to a non-locking position, at which the locked part is not engageably locked in the locking part and which is illustrated in FIG. 14.

In the embodiment, the locked part 111 is configured of a slide shaft 113, which is an example of a locked member that is provided so as to be movable with respect to the slide member 66 in a direction intersecting a surface of the rack member 64 along the forward/backward direction MD. The slide shaft 113 and a spring 114 biasing the slide shaft 113 in a direction of hitting a surface of the rack member 64 along the forward/backward direction MD are provided in the slide member 66 as a part of the holding state releasing mechanism 110. In addition, the rack member 64 has a surface 642 which is hit by the slide shaft 113 protruding from the slide member 66 by the biasing force of the spring 114 as illustrated in FIG. 13. As an example of the locking part 112 that can engageably lock in the slide shaft 113, a slope 115 is formed on the surface 642. When the rack member 64 moves in the first direction at the time of causing the wiper 61 to rise, the slide shaft 113 is engageably locked in the slope 115 and relative movement of the slide member 66 with respect to the rack member 64 in the forward/backward direction MD is restricted.

Specifically, as illustrated in FIG. 15, a recessed accommodating portion 661 stretching in a direction orthogonal to the surface 642 of the rack member 64 is formed in an end portion on a side opposite to the connecting unit 67 of the slide member 66 in the forward/backward direction MD. The slide shaft 113 and the spring 114 that biases the slide shaft 113 to the surface 642 of the rack member 64 are accommodated in the recessed accommodating portion 661. The slope 115 that can engageably lock in the slide shaft 113 is formed on the surface 642 of the rack member 64 in order to restrict movement in a direction of leaving a position where the slide member 66 is held by the rack member 64. A force (set load) necessary for the slide shaft 113 to be moved from the locking position beyond the slope 115 to the non-locking position is determined by the elastic force of the spring 114 and the difference in level and the gradient of the slope 115. In the embodiment, the values of the elastic force of the spring 114 and the difference in level and the gradient of the slope 115 are set to the extent that the wiper 61 is not shifted or detached from the wiper holder 65, or does not become damaged when the wiper 61 hits an obstacle while rising.

In a case where a load that is equal to or higher than the set value is received while the wiper 61 moves from the retracted position Ws to the wiping position W, the slide shaft 113 held by the slide member 66 rides up over the slope 115 and is displaced to the non-locking position against the biasing force of the spring 114. The slide shaft 113 moves from the locking position where the slide shaft is engageably locked in the slope 115 beyond the slope 115 to the non-locking position. For this reason, as illustrated in FIG. 14, connection between the slide member 66 and the rack member 64 is released and only the rack member 64 moves in the first direction even when the pinion 77 rotates. When the wiper hits an obstacle, such as the liquid ejecting head 27 and the medium M at an irregular position, and receives a load that is equal to or higher than the set value as the wiper 61 rises from the retracted position Ws to the wiping position W, the wiper 61 stops rising at that time point.

Figure 16:
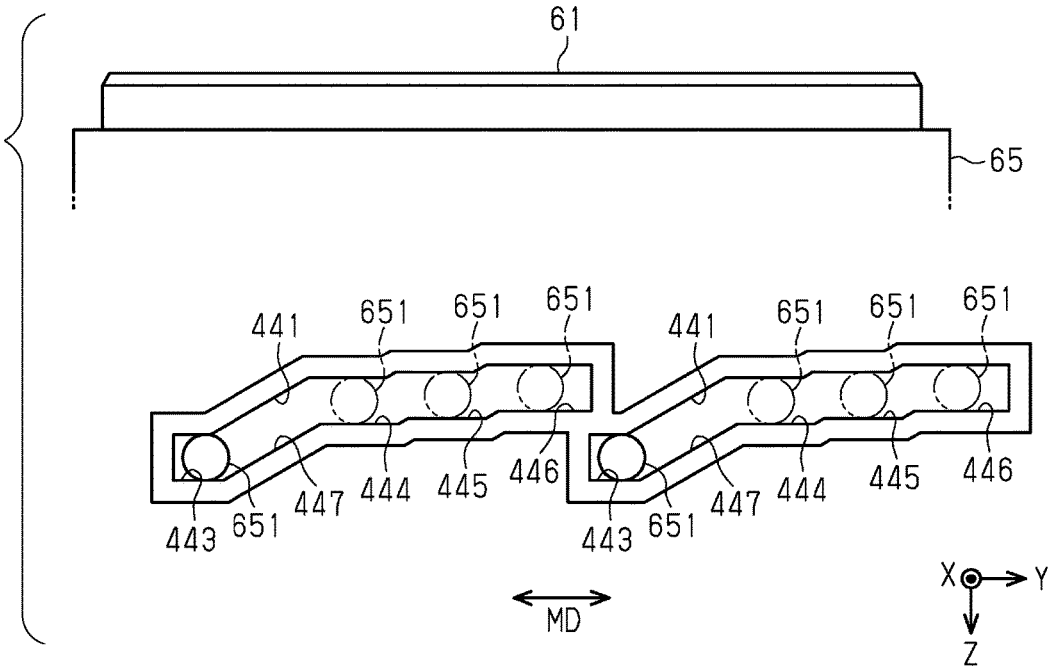
FIG. 16 is a side view illustrating the appearance of a guide pin of a wiper holder being guided by a guide hole.

Next, a mechanism, in which the guide pins 651 and 652 of the wiper holder 65 are guided by the guide holes 441 and 442 and cause the wiper 61 to rise/fall, will be described with reference to FIG. 16. The shape of each of the guide holes 441 and 442 corresponding to each of the upper and lower guide pins 651 and 652 is basically the same. For this reason, hereinafter, the guide pins 651 and the guide holes 441, which are positioned on an upper side in FIG. 16 will be described. As illustrated in FIG. 16, the guide holes 441 are formed by penetrating a path stretching in the forward/backward direction MD, and each have a path of which a position changes also in a direction (vertical direction Z) orthogonal to the nozzle surface 271 according to changes of positions in the forward/backward direction MD. Each of the guide pins 651 is engageably inserted in the corresponding guide holes 441.

As illustrated in FIG. 16, the wiper 61 slides along an oblique path that is displaced also in the vertical direction Z while moving in the forward/backward direction MD by the guide holes 441 guiding the guide pins 651. At this time, the height of the wiper 61 is adjusted in the direction orthogonal to the nozzle surface 271 depending on which position the wiper holder 65 is stopped in the forward/backward direction MD. The height of the wiper 61 of the embodiment is adjustable to a plurality of stages (three stages in the example), such as a wiping position W1 (first wiping position W1), a second wiping position W2 which is lower than the wiping position W1, and a third wiping position W3 which is lower than the second wiping position W2, as a wiping position where the nozzle surface 271 is wiped (also refer to FIG. 17).

As illustrated in FIG. 16, the guide holes 441 each have a plurality of (four, in the example) flat portions 443 to 446 of which positions are different in the forward/backward direction MD and of which positions (heights) are different also in the vertical direction Z orthogonal to the nozzle surface 271. The lowest flat portions 443 (hereinafter, referred to as "flat portions for retracted position") guide the guide pins 651 such that the wiper 61 is positioned at the height of the retracted position Ws. The other three flat portions 444 to 446 (hereinafter, referred to as "flat portions for wiping position") are different in height in stages and guide the guide pins 651 to heights when the wiper 61 is at the plurality of different wiping positions. In the guide holes 441, the guide pins 651 are disposed at a position shown with solid lines, to which the guide pins are guided by the flat portions 443, and at three positions shown with two-dot chain lines to which the guide pins are guided by the first flat portions 446, the second flat portions 445, and the third flat portions 444. Slopes 447 having a predetermined gradient, which gradually increases in a direction (right direction in FIG. 16) where the wiper 61 moves from the retracted position Ws to the wiping position W1 in the forward/backward direction MD, are provided between the flat portions 443 and the third flat portions 444. In addition, short slopes having substantially the same gradient as the slopes 447 are provided also between each of the flat portions 444 to 446 for wiping position. The shapes of the guide holes 441 in the upper tier and a positional relationship between the guide pin 651 and the guide hole 441 in the upper tier are illustrated in FIG. 16, and the guide pins 652 in the lower tier and the guide holes 442 in the lower tier are the same as the guide pins and the guide holes in the upper tier in terms of shapes and positional relationships.

Figure 17:
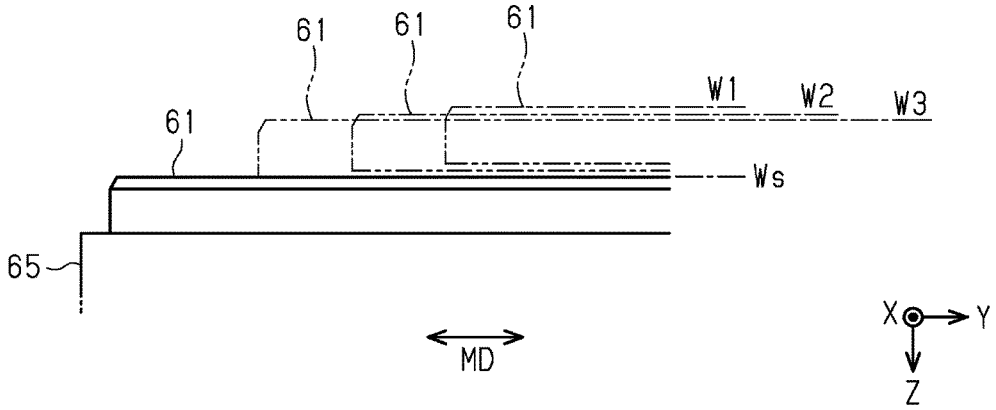
FIG. 17 is a partial side view illustrating a wiping position of the wiper.

As illustrated in FIG. 17, a second wiping position W2, which is a position closer to the retracted position Ws than the wiping position W1 in an orthogonal direction that is orthogonal to the nozzle surface 271 and at which the nozzle surface 271 is wiped, is set between the retracted position Ws and the wiping position W1 in the forward/backward direction MD. A third wiping position W3, which is a position closer to the retracted position Ws than the second wiping position W2 in the orthogonal direction and at which the nozzle surface 271 is wiped, is set. In the embodiment, when the aforementioned highest wiping position is set as the first wiping position W1, the second wiping position W2 and the third wiping position W3 are set as contact positions that are positioned closer to the retracted position than the first wiping position W1. That is, in the embodiment, the first wiping position W1 is set as a wiping position that is the farthest away from the retracted position Ws in the forward/backward direction MD. The second wiping position W2 and the third wiping position W3 are set in order of being close to the first wiping position W1 in the orthogonal direction that is orthogonal to the nozzle surface 271.

When the guide pins 651 illustrated in FIG. 16 are disposed on the flat portions 443, the wiper 61 is disposed at the retracted position Ws shown with the solid line in FIG. 17. When the guide pins 651 illustrated in FIG. 16 are disposed on the first flat portions 446, the wiper 61 is disposed at the first wiping position W1 shown with the two-dot chain line in FIG. 17. When the guide pins 651 illustrated in FIG. 16 are disposed on the second flat portions 445, the wiper 61 is disposed at the second wiping position W2 (<W1) shown with the two-dot chain line in FIG. 17. When the guide pins 651 illustrated in FIG. 16 are disposed on the third flat portions 444, the wiper 61 is disposed at the third wiping position W3 (<W2) shown with the two-dot chain line in FIG. 17.

Figure 18:
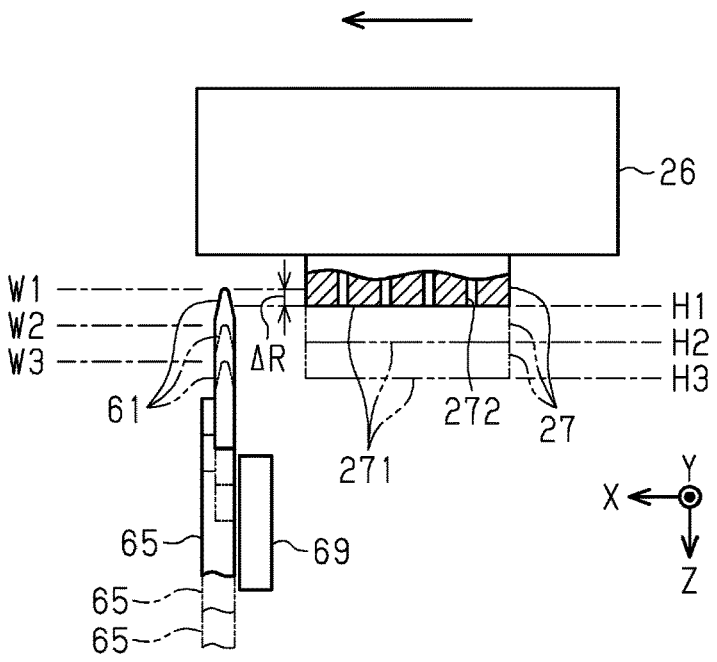
FIG. 18 is a schematic front view illustrating a relationship between a height of the liquid ejecting head and the wiping position of the wiper.

As illustrated in FIG. 18, the liquid ejecting head 27 is displaceable in the direction (vertical direction Z) orthogonal to the nozzle surface 271 by the driving of the gap adjusting mechanism 33 (refer to FIG. 2). When a printing job is acquired, the control unit 37 drives the gap adjusting mechanism 33 such that a gap according to the thickness of the medium M defined from information of medium type included in the printing job. Consequently, a gap between the nozzle surface 271 of the liquid ejecting head 27 and the medium M is adjusted to an appropriate value.

As illustrated in FIG. 18, in a case where the medium M is the thickest, the liquid ejecting head 27 is disposed at a first position H1 shown with a solid line in FIG. 18. In a case where the medium M has a medium thickness, the liquid ejecting head 27 is disposed at a second position H2 shown with a two-dot chain line in FIG. 18. In a case where the medium M is the thinnest, the liquid ejecting head 27 is disposed at a third position H3 shown with a two-dot chain line in FIG. 18.

As illustrated in FIG. 18, the liquid ejecting head 27 has the plurality of nozzles 272 as illustrated with a partial section in FIG. 18. Mist generated when the droplets of an ink from the nozzles 272 are ejected adheres to the nozzle surface 271 during printing. In addition, droplets scattered when a liquid such as an ink is forcibly suction-discharged from the nozzles 272 during cleaning adhere to the nozzle surface 271, in some cases. Droplets adhered to the vicinity of the nozzles 272 are causes of flight deflection of droplets when droplets are ejected from the nozzles 272, and bring about a shift in the landing positions of the droplets, which leads to a decline in printing quality. For this reason, wiping in which the wiper 61 wipes the nozzle surface 271 to remove the adhered liquid is performed.

The control unit 37 selects one position from the first to third wiping positions W1 to W3 according to the height position of the liquid ejecting head 27 and drives the electric motor 71 to move the wiper moving mechanism 62 to a position corresponding to the selected wiping position W. As illustrated in FIG. 18, when the liquid ejecting head 27 is at the first position H1, the wiper 61 is disposed at the first wiping position W1, which is the highest position shown with the solid line in FIG. 18. In this state, a predetermined overlapping amount ΔR (overlap amount) is ensured between the liquid ejecting head 27 and the wiper 61 in the vertical direction Z. When the liquid ejecting head 27 is at the second position H2, the wiper 61 is disposed at the second wiping position W2, which is the second highest position shown with the two-dot chain line in FIG. 18. When the liquid ejecting head 27 is at the third position H3, the wiper 61 is disposed at the third wiping position W3, which is the lowest wiping position shown with the two-dot chain line in FIG. 18. Even in the case of the second wiping position W2 and the third wiping position W3, the predetermined overlapping amount ΔR is ensured between the liquid ejecting head 27 and the wiper 61 in the vertical direction Z. In the description below, in a case where the plurality of wiping positions W1 to W3 are not particularly differentiated, the wiping positions W1 to W3 are simply referred to as the "wiping position W", and in a case where the plurality of height positions H1 to H3 of the liquid ejecting head 27 are not particularly differentiated, the height positions H1 to H3 are simply referred to as the "height position H".

The wiper 61 moves to the contact position where the wiper can come into contact with the nozzle surface 271 while the wiper 61 moves from the retracted position Ws that is spaced away from the nozzle surface 271 to the wiping position W1 in the orthogonal direction that is orthogonal to the nozzle surface 271. For this reason, even when the liquid ejecting head 27 is at the highest position during printing, the predetermined overlapping amount ΔR is ensured between the liquid ejecting head 27 and the wiper 61 in the orthogonal direction. By the predetermined overlapping amount ΔR being ensured, the wiper 61 can appropriately wipe the nozzle surface 271.

Figure 19:
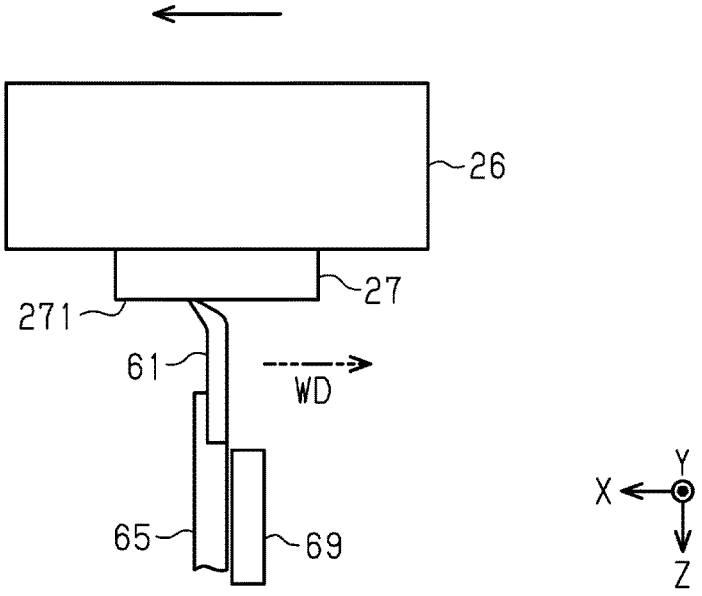
FIG. 19 is a schematic front view illustrating wiping operation of a nozzle surface by the wiper.

As illustrated in FIG. 19, after the wiper 61 is disposed at the predetermined wiping position W according to the height position H of the liquid ejecting head 27 illustrated in FIG. 18, the carriage 26 moves by a predetermined distance necessary for wiping in a direction from the maintenance position opposing the cap 51 (refer to FIG. 2) to the printing region PA shown with an arrow in FIG. 19. As a result, also in the case of any one of the height position H and the wiping position W in FIG. 18, the wiper 61 wipes the nozzle surface 271 by the appropriate overlapping amount ΔR. At this time, the tip portion of the wiper 61 comes into contact with the nozzle surface 271 at a predetermined contact pressure and slides on the nozzle surface 271 in a state of being slightly bent to remove a liquid efficiently.

As illustrated in FIG. 19, the maintenance device 36 includes a wiper cleaner 69, which is an example of an absorbing member, at a position where the wiper cleaner comes into contact with a surface of the wiper 61 on a forward traveling side of the wiping direction WD when the wiper 61 is at the retracted position. The liquid wiped off the surface on the forward traveling side of the wiping direction WD adheres to the wiper 61 which finished wiping. When the wiper 61 which finished wiping falls from the wiping position W to the retracted position, the wiper cleaner 69 comes into contact with the surface of the wiper 61 on the forward traveling side of the wiping direction WD. Consequently, the liquid adhered to the wiper 61 is absorbed by the wiper cleaner 69, and the liquid is removed from the wiper 61.

Figure 21:
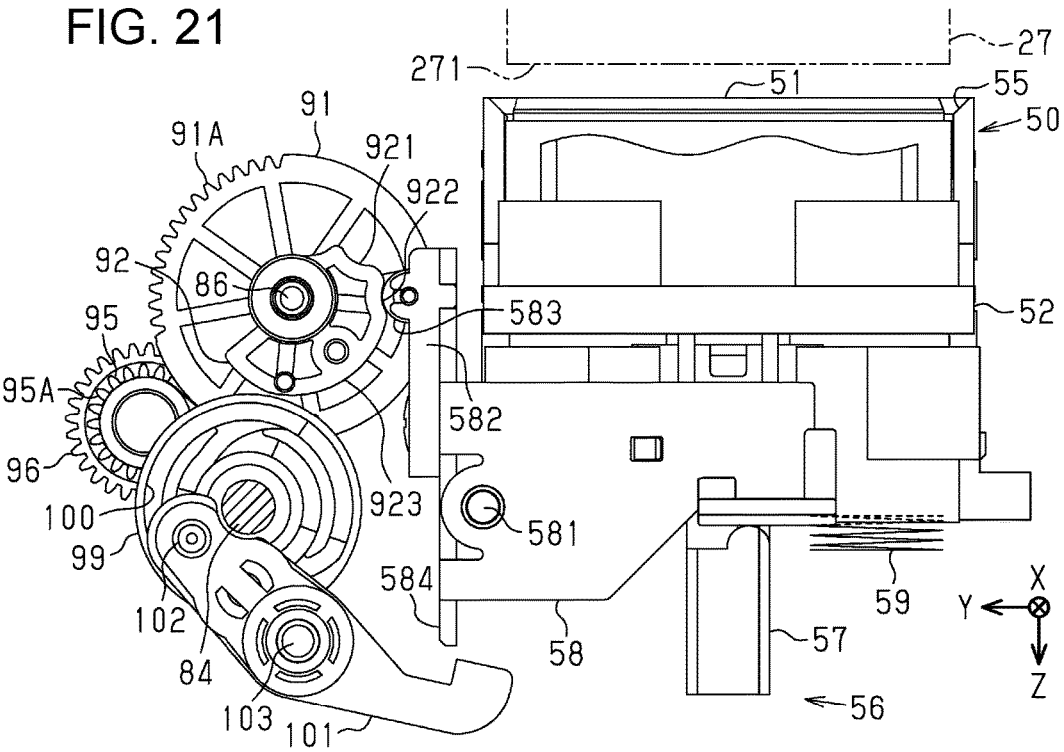
FIG. 21 is a side view illustrating the cap unit which is in a state where the cap is at an open position.
Figure 22:
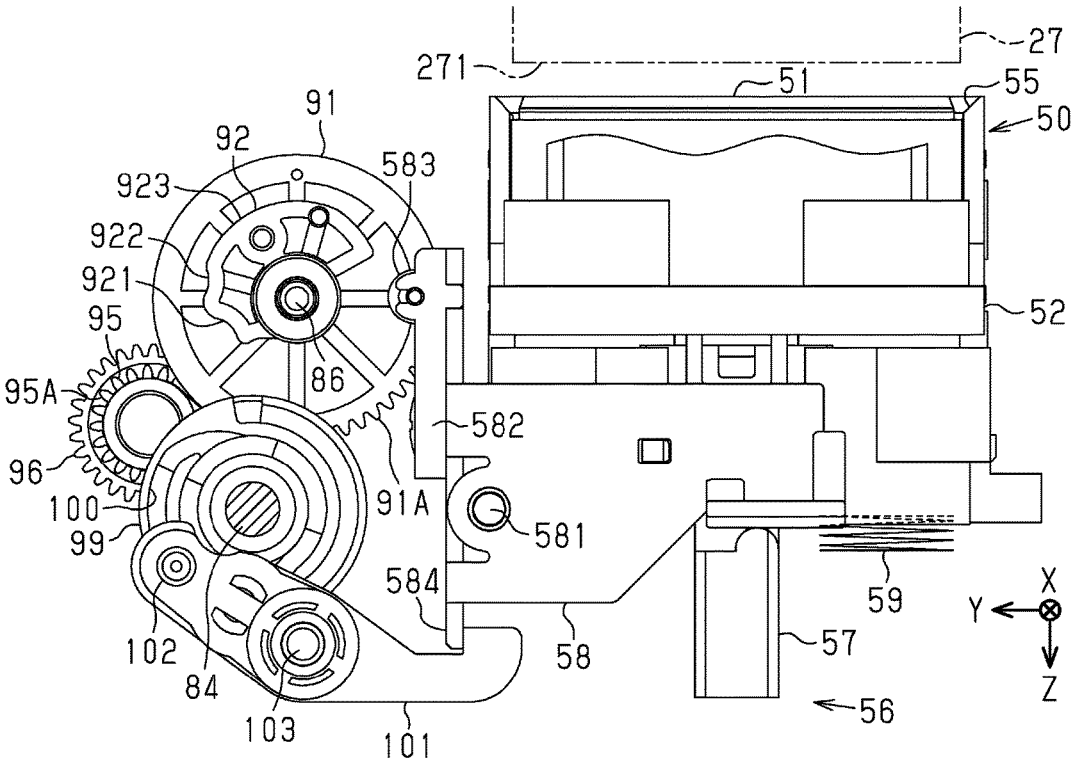
FIG. 22 is a side view illustrating the cap unit of which the cap is held by a cap pressing lever at the open position.

Next, rising/falling operation of the rising/falling mechanism 56 of the cap 51 will be described with reference to FIGS. 20 to 25. FIG. 20 illustrates a state where the cap 51 is at the capping position, and FIGS. 21 and 22 illustrate a state where the cap 51 is at the non-capping position. As illustrated in FIGS. 20 to 22, the rising/falling mechanism 56 includes the rising/falling rod 57, the cap rising/falling lever 58, the spring 59, the first cam 91, the intermittent gear 95, the second cam 99, and the cap pressing lever 101. The rising/falling mechanism 56 includes the first cam 91 and the second cam 99 of the motive power transmitting mechanism 72.

A cam follower 582 that is engageable with the first cam 91 is provided in the cap rising/falling lever 58 that is supported so as to be revolvable around the spindle 581 in a state where an end portion thereof is connected to the cap holder 52 biased upwards by the spring 59. The cam follower 582 has a roller 583, which is an example of a rotating body engageable with the outer circumferential surface (cam surface) of the cam unit 92 of the first cam 91, on a tip portion thereof. Specifically, the cap rising/falling lever 58 has a substantially U-shaped lever member in planar view, which surrounds the lower portion of the cap holder 52, for example, from three directions. The cam follower 582 runs in an arm shape from a portion of the lever member opposing the first cam 91 and the roller 583 is pivotally supported by the tip portion having an arm shape.

As illustrated in FIG. 21, the first cam 91 causes the cap rising/falling lever 58 to revolve in the first revolving posture in a section of a rotation angle at which the cam follower 582 engages with the outer circumferential surface (cam surface) of the cam unit 92. In addition, as illustrated in FIG. 20, the first cam 91 allows the cap rising/falling lever 58 to revolve in the second revolving posture illustrated in FIG. 20 by the biasing force of the spring 59 in a section of a rotation angle at which engagement of the cam unit 92 and the cam follower 582 is released.

As illustrated in FIG. 20, the second cam 99 rotates in a rotation angle range where the teeth portion 91A of the first cam 91 is fitted into the teeth portion 95A of the intermittent gear 95. Near the second cam 99, the cap pressing lever 101 is supported in a state of being revolvable around a spindle 103. The cam pin 102 provided in the base end portion of the cap pressing lever 101 is engageably inserted in the cam groove 100 recessed in one side surface of the second cam 99. The cap rising/falling lever 58 has an engaged unit 584 protruding downwards at a portion (lower end portion) opposing a tip portion of the cap pressing lever 101 on a side opposite to the cam pin 102.

In a state illustrated in FIG. 20, the roller 583 of the cam follower 582 releases engagement of the first cam 91 and the cam unit 92, and the cap holder 52 is lifted with the tilting of the cap rising/falling lever 58 by the biasing force of the spring 59. As a result, the cap 51 comes into contact with the nozzle surface 271 and is disposed at the capping position where a space including the nozzles 272 is formed. The disposition of the cap 51 at the capping position is performed during printing stand-by and during cleaning. The rotation position of the first cam 91 illustrated in FIG. 20 is a cap closed position and a suction position. In the example, a rotation angle when the first cam 91 is at the cap closed position and the suction position is, for example, 0°.

The suction pump 75 is driven in a state where the first cam 91 is at the suction position (rotation angle of 0°) illustrated in FIG. 20. The suction pump 75 is driven in a direction where the electric motor 71 rotates the first cam 91 in a clockwise direction in FIG. 20, and at this time, the first cam 91 is at the rotation angle of 0°, which is a rotation limit in the clockwise direction. For this reason, during cleaning operation in which the suction pump 75 is driven, the first cam 91 is kept at the rotation angle of 0° and the cap 51 is held at the capping position.

When the first cam 91 rotates from the rotation angle illustrated in FIG. 20 to a rotation angle illustrated in FIG. 21, the roller 583 of the cam follower 582 engages with the cam unit 92 and is displaced to a position close to the outer circumference of the first cam 91. As a result, the cap rising/falling lever 58 revolves around the spindle 581 from the first revolving posture illustrated in FIG. 20 to the second revolving posture in the clockwise direction in FIG. 20. As a result, the cap holder 52 is pushed down against the biasing force of the spring 59, and the cap 51 is disposed at the non-capping position, which is separated away from the nozzle surface 271 illustrated in FIG. 21.

In some cases, the suction pump 75 is needed to be driven when the cap 51 is at the non-capping position. For this reason, as illustrated in FIG. 22, the cap pressing lever 101 is caused to revolve from a state illustrated in FIG. 21 to a state illustrated in FIG. 22 by the cam pin 102 being guided by the cam groove 100 of the second cam 99. In the state illustrated in FIG. 22, the cap pressing lever 101 presses the engaged unit 584 from below to lift the cap rising/falling lever 58. Since the cap rising/falling lever 58 takes the first revolving posture of revolving around the spindle 581 in the clockwise direction of FIG. 22, the cap 51 is disposed at the non-capping position. When the suction pump 75 is driven in this state, a liquid can be discharged from the cap 51 in a state where the cap 51 is disposed at the non-capping position.

For example, flushing (idle ejection), in which the carriage 26 is moved to the home position HP during printing and droplets not related to printing are ejected from all of the nozzles 272 of the liquid ejecting head 27 to the cap 51 disposed at the non-capping position, is performed. In the flushing, a liquid such as a thickened ink within the unused nozzles 272 is discharged to refresh a liquid within the nozzles 272, preventing the clogging of the nozzles 272. Since a liquid stagnates in the cap 51 when flushing is repeatedly performed, the suction pump 75 is driven during printing on a regular or irregular basis and the liquid stagnating in the cap 51 is discharged.

Figure 23:
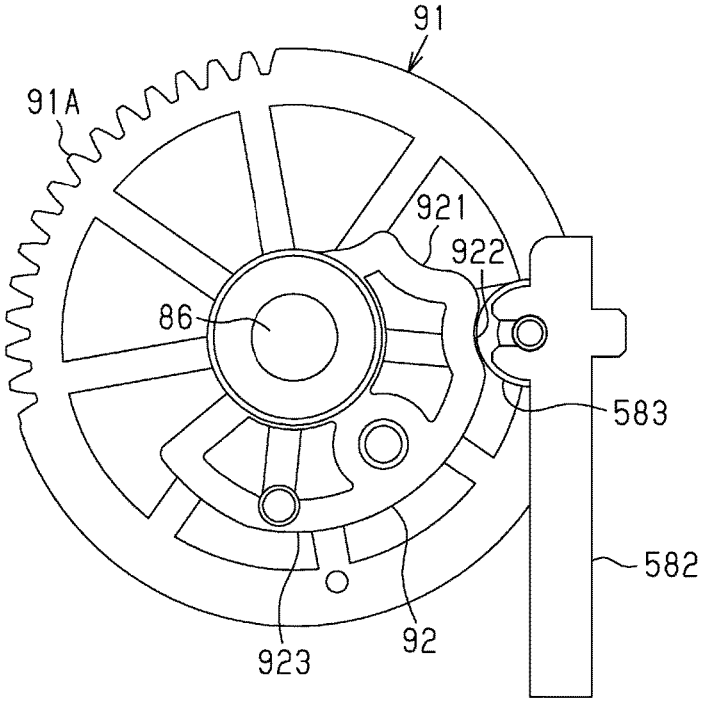
FIG. 23 is a side view illustrating a positional relationship between a second cam and a cam follower of a cap rising/falling lever.

Next, the cam unit 92 of the first cam 91 and the cam follower 582 will be described with reference to FIG. 23. As illustrated in FIG. 23, the cam unit 92 has a shape in which a portion around the rotation shaft 86 of the first cam 91, which spans in a predetermined angle range, bulges in a diameter direction. For this reason, a distance from the rotation shaft 86 to the outer circumferential surface of the cam unit 92 in the diameter direction is long compared to a portion around the rotation shaft 86 where there is no cam unit 92. The outer circumferential surface of the cam unit 92 is a cam surface with which the roller 583 engages. The cam unit 92 has a first recessed portion 921, which is an example of a recessed portion, at an end portion in a counterclockwise direction of FIG. 23, and has a second recessed portion 922, which is an example of a recessed portion, at a position next to the first recessed portion 921 in the clockwise direction. The second recessed portion 922 has a longer distance from the rotation shaft 86 in the diameter direction than the first recessed portion 921. In a state where the roller 583 is engaged with the second recessed portion 922 as illustrated in FIGS. 21 and 23, the cap rising/falling lever 58 illustrated in FIG. 21 is disposed in the first revolving posture. As a result, the cap 51 is disposed at the non-capping position.

As illustrated in FIG. 23, a portion of the cam unit 92, which is positioned further to the clockwise direction than the second recessed portion 922, is a cam surface 923 having a substantially arc shape. In a section where the roller 583 engages with the cam surface 923, the cap rising/falling lever 58 is disposed so as to be in the first revolving posture and the cap 51 is held at the non-capping position. In the section where the roller 583 engages with the cam surface 923, the cap 51 is disposed at the non-capping position since the section corresponds to a rotation region of the second cam 99 where rising/falling operation of the wiper 61 is performed.

When the first recessed portion 921 is engaged with the roller 583, the cap rising/falling lever 58 is held in a revolving posture revolved slightly in the counterclockwise direction from the first revolving posture illustrated in FIG. 20. At the position of the rising/falling rod 57 at this time, the carriage 26 is locked by engagement with the lock member 73, and the cap 51 is disposed at the non-capping position. For example, in a case where the liquid ejecting apparatus 11 is stored in a warehouse when the apparatus is not used, it is necessary to discharge all liquids within the liquid ejecting head 27 depending on the type of liquid to be used and to dispose the cap 51 at the non-capping position. In this case, the roller 583 of the cam follower 582 is caused to engage with the first recessed portion 921.

Reasons for providing the recessed portions 921 and 922 in an engaged portion where the roller 583 engages with the cam unit 92 when the first cam 91 is stopped at a target rotation angle where the cap 51 is disposed at the non-capping position are as follows. When the roller 583 presses the first recessed portion 921 or the second recessed portion 922 by the biasing force of the spring 59, the first cam 91 slightly rotates in a direction of positioning the roller 583 at the center of the recessed portions 921 and 922 by the pressing force. The rotation stop position of the first cam 91 varies in some cases when the first cam 91 is rotated so as to be at the target rotation angle by the rotation the electric motor 71 being controlled. Even when the rotation stop position of the first cam 91 somewhat varies, the first cam 91 stops at an appropriate target rotation angle insofar as the first cam 91 rotates in the direction of positioning the roller 583 at the center of the recessed portions 921 and 922 by the pressing force received from the roller 583.

Figure 24:
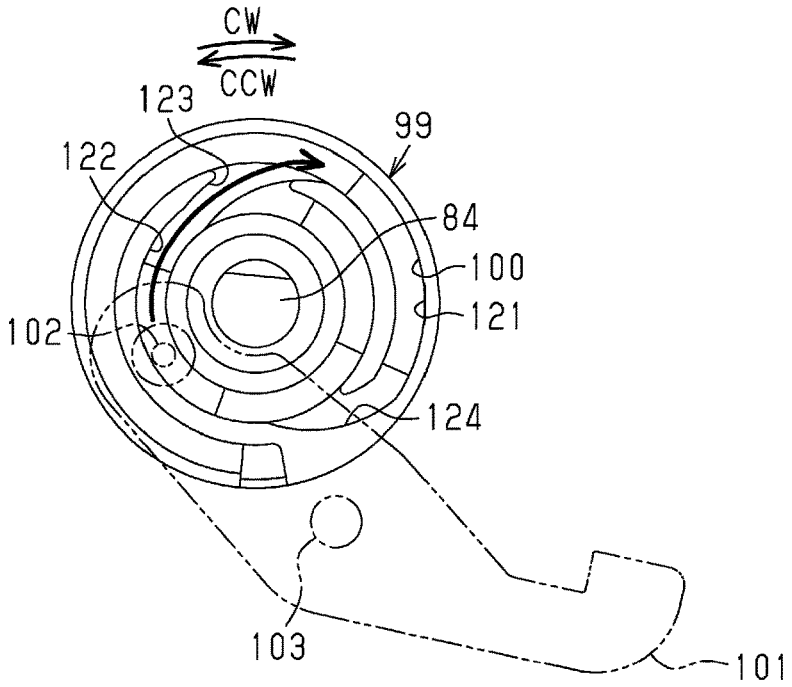
FIG. 24 is a side view illustrating a state where the second cam has disposed the cap pressing lever at a set position.
Figure 25:
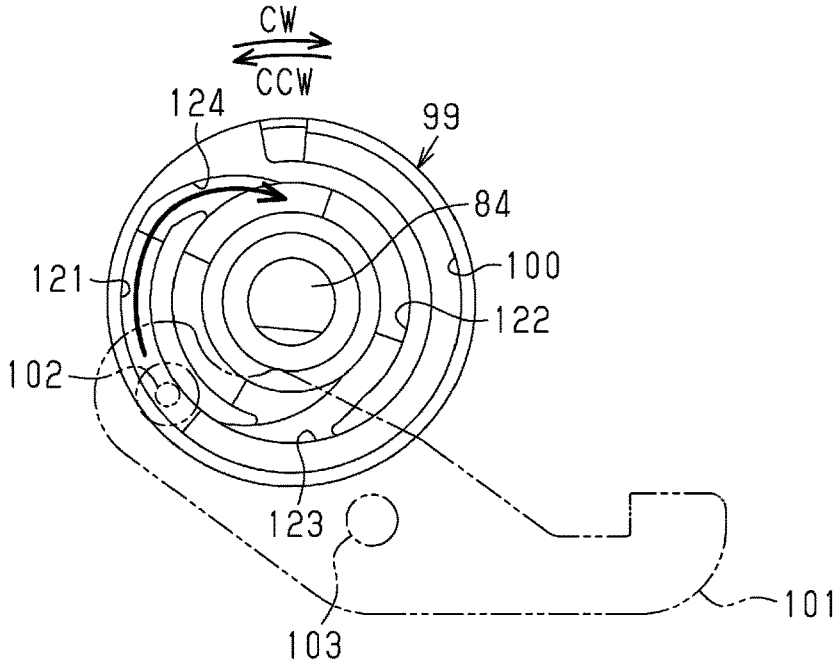
FIG. 25 is a side view illustrating a state where the second cam has disposed the cap pressing lever at a reset position.

Next, operation of the cap pressing lever 101 by the second cam 99 will be described with reference to with reference to FIGS. 24 and 25. FIG. 24 illustrates a state where the cap pressing lever 101 is disposed at the reset position, and FIG. 25 illustrates a state where the cap pressing lever 101 is disposed at the set position. As illustrated in FIG. 24, the cam groove 100 of the second cam 99 has a first cam groove portion 121 passing through an outer circumferential side, a second cam groove portion 122 passing through an inner circumferential side, and a first connection groove portion 123 and a second connection groove portion 124 connecting the first cam groove portion 121 and the second cam groove portion 122 together at two places of which positions in a circumferential direction are different.

As illustrated in FIG. 24, in a state where the cam pin 102 of the cap pressing lever 101 is positioned at the second cam groove portion 122 on the inner circumferential side of the second cam 99, the cap pressing lever 101 is disposed at the reset position where the cap rising/falling lever 58 is not held. As illustrated in FIG. 25, in a state where the cam pin 102 is positioned at the first cam groove portion 121 on the outer circumferential side of the second cam 99, the cap pressing lever 101 is disposed at the set position where the cap rising/falling lever 58 is lifted and held. When the second cam 99 rotates in a counterclockwise direction CCW from the state illustrated in FIG. 24 and the cam pin 102 moves along the cam groove 100 in a clockwise direction CW shown with an arrow, the cap pressing lever 101 is disposed at the set position illustrated in FIG. 25. In addition, when the second cam 99 rotates in the counterclockwise direction CCW from the state illustrated in FIG. 25 and the cam pin 102 moves along the cam groove 100 in the clockwise direction CW shown with the arrow, the cap pressing lever 101 is disposed at the reset position illustrated in FIG. 24.

Figure 26:
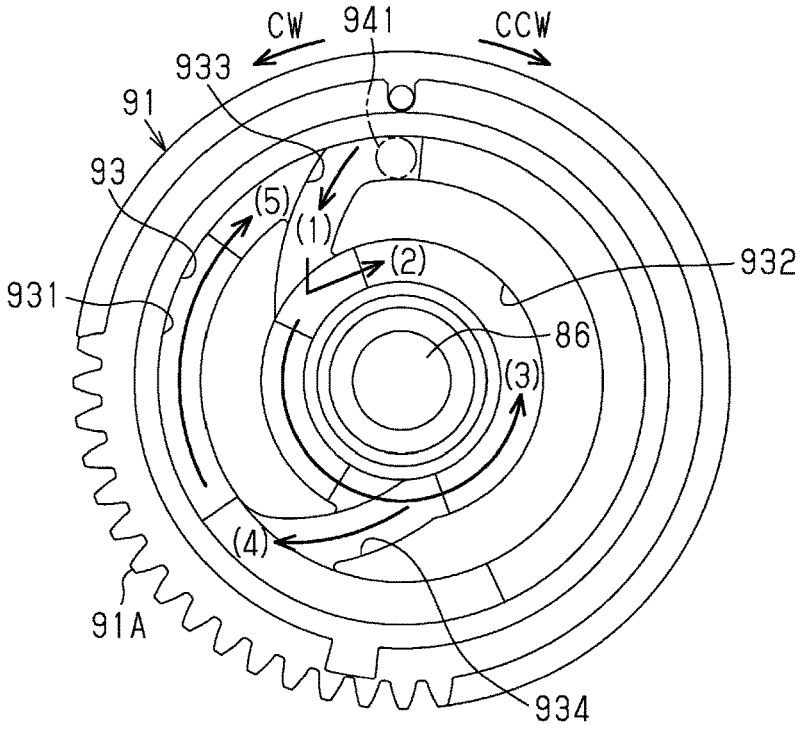
FIG. 26 is a side view illustrating a cam groove of a first cam.

Next, opening/closing operation of the atmospheric release valve 78 performed by the rotation of the first cam 91 will be described with reference to FIG. 26. As illustrated in FIG. 26, the cam pin 941 of the oscillating member 94 (refer to FIG. 11) is engageably inserted in the cam groove 93 of the first cam 91. The cam groove 93 has a first cam groove portion 931 passing through an outer circumferential side, a second cam groove portion 932 passing through an inner circumferential side, and a first connection groove portion 933 and a second connection groove portion 934 connecting the first cam groove portion 931 and the second cam groove portion 932 together at two places of which positions in a circumferential direction are different.

The position of the cam pin 941 shown with a two-dot chain line in FIG. 26 is a position guided by the cam groove 93 when the first cam 91 is at the rotation angle of 0°. When the first cam 91 rotates in the clockwise direction CW, the cam pin 941 moves in the counterclockwise direction CCW, and when the first cam 91 rotates in the counterclockwise direction CCW, the cam pin 941 moves in the clockwise direction CW.

The control unit 37 controls the electric motor 71, and controls the rotation angle of the first cam 91 by rotating the first cam 91 in the clockwise direction CW and the counterclockwise direction CCW as illustrated in FIG. 26. The control unit 37 controls the rotation angle of the first cam 91 to move the cam pin 941, for example, through a path of (1) to (5) shown with arrows in FIG. 26. When the cam pin 941 is positioned at the first cam groove portion 931 on the outer circumferential side of the first cam 91, the oscillating member 94 is disposed at a valve closed position and the atmospheric release valve 78 closes. When the cam pin 941 is positioned at the second cam groove portion 932 on the inner circumferential side of the first cam 91, the oscillating member 94 is disposed at a valve open position and the atmospheric release valve 78 opens.

Figure 27:
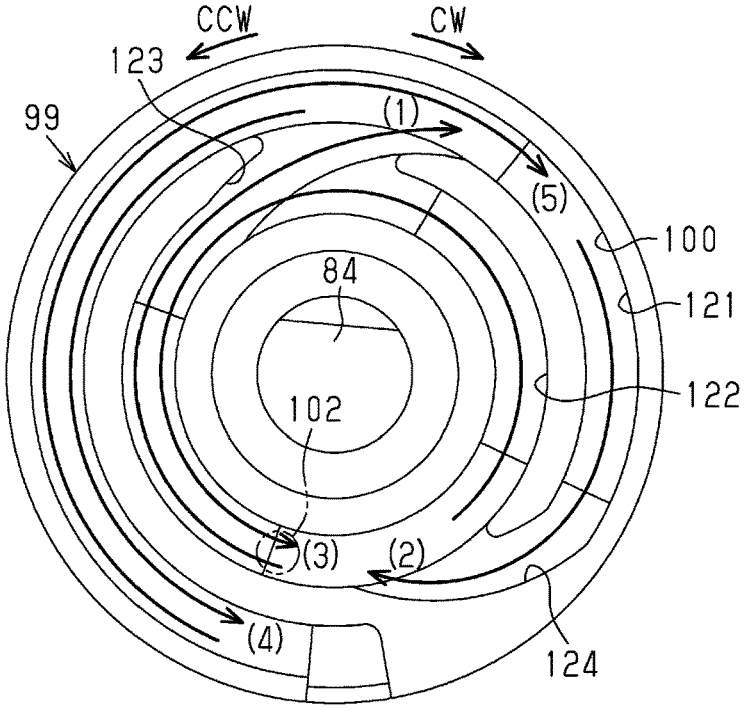
FIG. 27 is a side view illustrating a cam groove of a second cam.

Next, revolving operation of the cap pressing lever 101 performed by the rotation of the second cam 99 will be described with reference to FIG. 27. As illustrated in FIG. 27, the cam pin 102 of the cap pressing lever 101 is engageably inserted in the cam groove 100 of the second cam 99. As described above, the cam groove 100 has the first cam groove portion 121 on the outer circumferential side, the second cam groove portion 122 on the inner circumferential side, and the first and second connection groove portions 123 and 124 connecting both of the cam groove portions 121 and 122 together at positions different in the circumferential direction.

The position of the cam pin 102 shown with a two-dot chain line in FIG. 27 is a position guided by the cam groove 100 when the first cam 91 is at the rotation angle of 0°. In the example, the second cam 99 rotates when the first cam 91 is within a range of the rotation angle of 205 to 310°. For this reason, when the first cam 91 is within a range of the rotation angle of 0 to 205°, the cam pin 102 is disposed at the position shown with the two-dot chain line in FIG. 27. When the second cam 99 rotates in the clockwise direction CW, the cam pin 102 moves in the counterclockwise direction CCW, and when the second cam 99 rotates in the counterclockwise direction CCW, the cam pin 102 moves in the clockwise direction CW, under the condition that the rotation angle of the first cam 91 is in a range of 205 to 310° in the example.

The control unit 37 controls the electric motor 71, and controls the rotation angle of the second cam 99 by rotating the second cam 99 in the clockwise direction CW and the counterclockwise direction CCW as illustrated in FIG. 27. The control unit 37 controls the rotation angle of the second cam 99 to move the cam pin 102, for example, through a path of (1) to (5) shown with arrows in FIG. 27. When the cam pin 102 is positioned at the second cam groove portion 122 on the inner circumferential side of the second cam 99, the cap pressing lever 101 is disposed at the reset position (refer to FIG. 24). When the cam pin 102 is positioned at the first cam groove portion 121 on the outer circumferential side of the second cam 99, the cap pressing lever 101 is disposed at the set position (refer to FIG. 25).

The control unit 37 executes a program for maintenance control stored in a memory to control the rotation of the electric motor 71. The control unit 37 controls driving of the cap 51, the wiper 61, the lock member 73, and the atmospheric release valve 78 by controlling the rotation angles of the first cam 91 and the second cam 99. When a predetermined suction driving time comes, the control unit 37 reverse rotation-drives the electric motor 71 to drive the suction pump 75. The maintenance device 36 of the example includes an encoder (not illustrated) (for example, a rotary encoder) that outputs an encoder signal including pulses of which the number is proportional to the rotation amount of the electric motor 71. The control unit 37 performs counting of adding or subtracting the number of pulse edges of the encoder signal input from the encoder according to the rotation direction of the electric motor 71 and detects the rotation angle of the first cam 91 based on the counted value. The control unit 37 controls the electric motor 71 based on the detected rotation angle of the first cam 91 and controls the rotation angles of the first cam 91 and the second cam 99.

Figure 28:
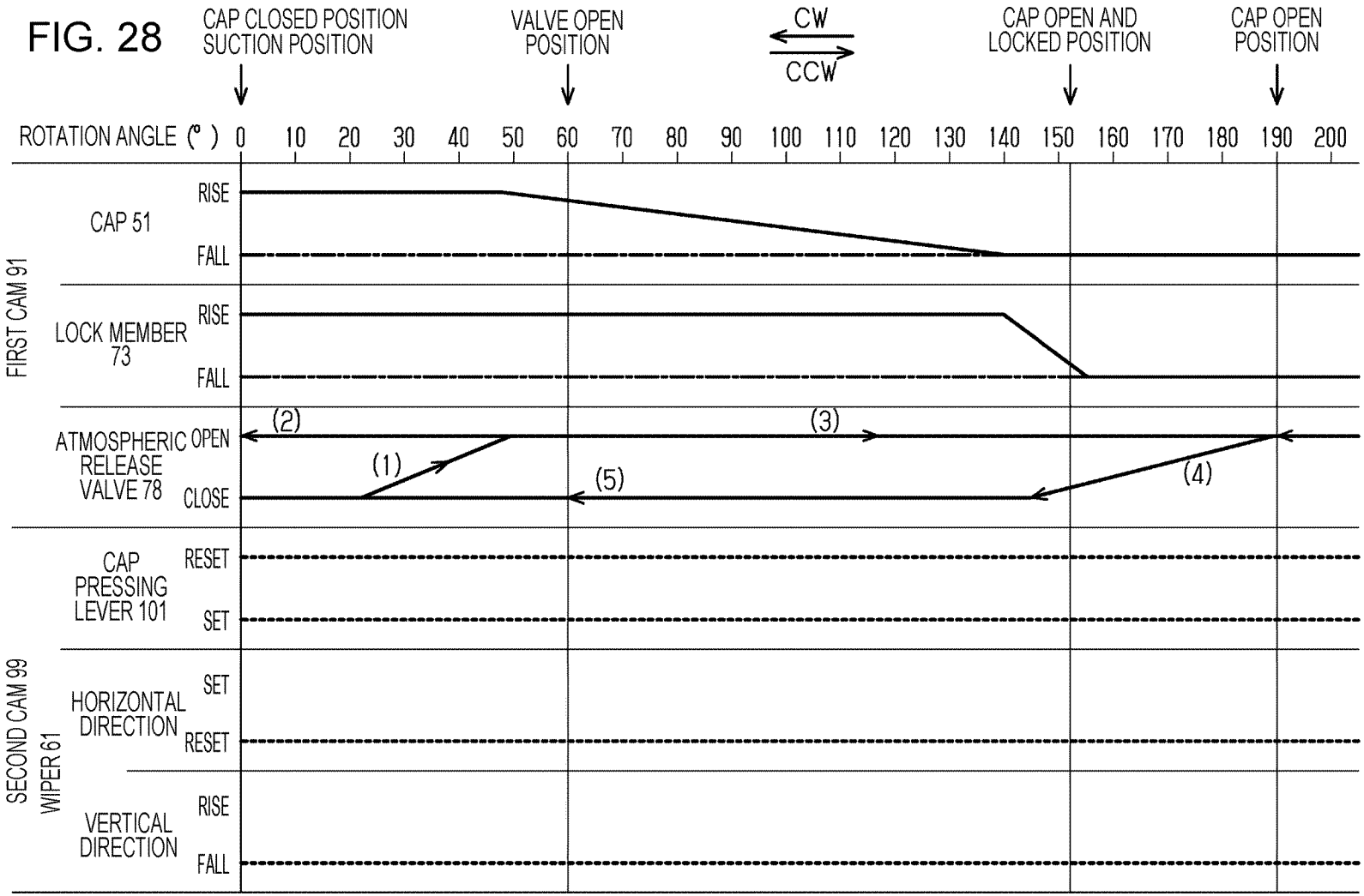
FIG. 28 is an operation explanatory diagram showing operation of the cap and the wiper by the first cam and the second cam.
Figure 29:
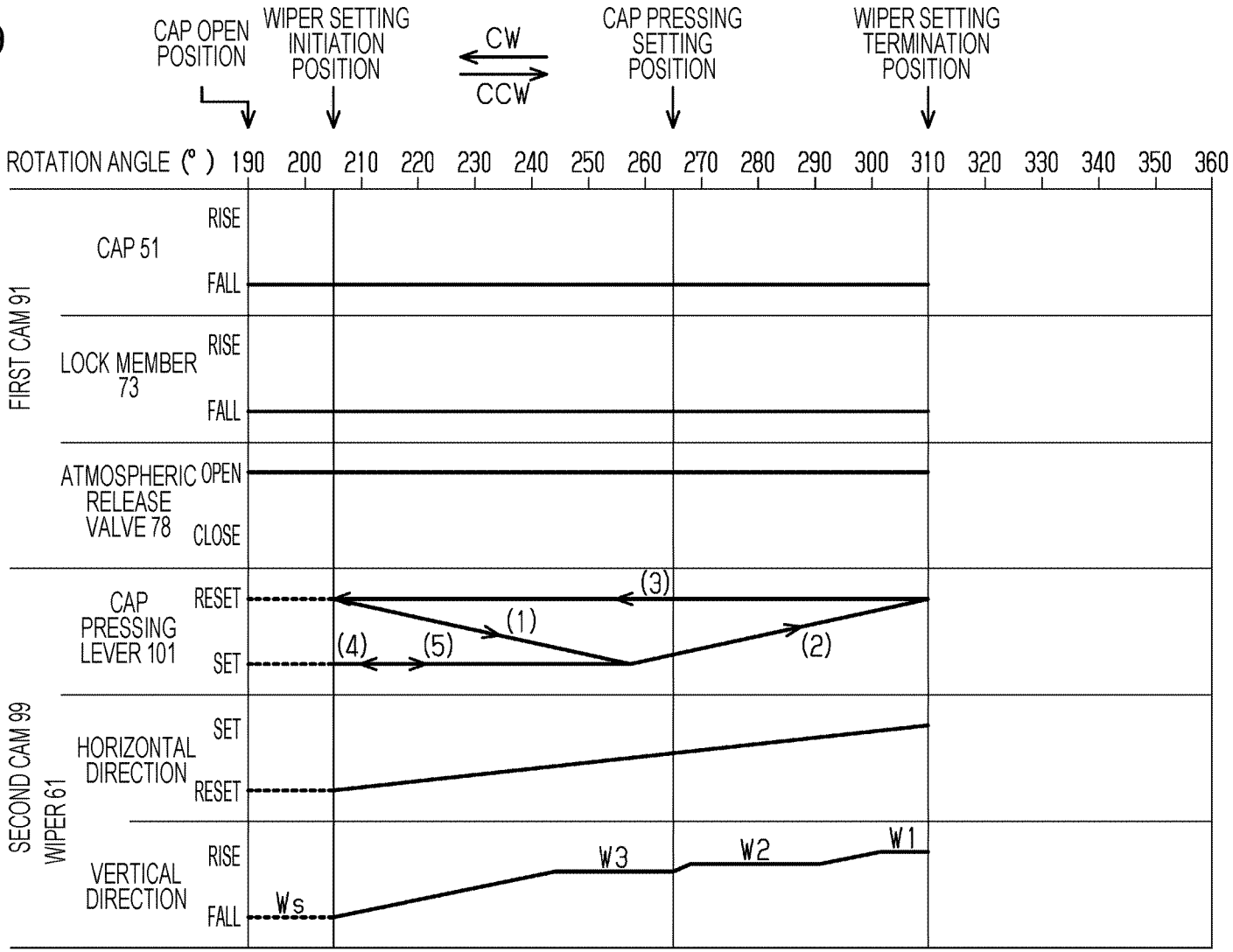
FIG. 29 is the same operation explanatory diagram.

FIGS. 28 and 29 are mechanical time charts showing a relationship between the rotation angles of the first cam 91 and the second cam 99 and operation of each of the cap 51, the lock member 73, the atmospheric release valve 78, the cap pressing lever 101, and the wiper 61. In FIGS. 28 and 29, a rotation angle (°) indicates a rotation angle when the cap closed position (suction position) of the first cam 91 is set as the rotation angle of 0°. The first cam 91 rotates in a range of the rotation angle of 0° to 310°. The second cam 99 rotates in a range of the rotation angle of 205° to 310°, at which the first cam 91 can mesh with the intermittent gear 95.

FIG. 28 shows each piece of operation of the first cam 91 in a range of the rotation angle of 0° to 200°, and FIG. 29 shows each piece of operation of the first cam 91 in a range of the rotation angle of 190° to 360°. In FIGS. 28 and 29, each piece of operation of the cap 51, the lock member 73, and the atmospheric release valve 78 according to the rotation angle of the first cam 91 is shown with a bold line or a one-dot chain line. In FIGS. 28 and 29, each piece of operation of the cap pressing lever 101 and the wiper 61 is shown with dashed lines in a range of the rotation angle of 0 to 205° where the second cam 99 does not rotate, and is shown with bold lines in a range of the rotation angle of 205° to 310° where the second cam 99 rotates.

In FIG. 28, each piece of operation of the cap 51 and the lock member 73 is determined according to the rotation angle of the first cam 91 and the revolving position (reset/set position) of the cap pressing lever 101. In FIG. 28, operation of the cap 51 and the lock member 73 when the cap pressing lever 101 is at the reset position is shown with bold lines, and operation of the cap 51 and the lock member 73 when the cap pressing lever 101 is at the set position is shown with one-dot chain lines. In the description below, in some cases, the non-capping position of the cap 51 is referred to as a fallen position, the capping position is referred to as a risen position, the lock released position of the lock member 73 is referred to as a fallen position, and the locked position is referred to as a risen position, in accordance with FIGS. 28 and 29. In FIGS. 28 and 29, operation of the wiper 61 is divided into displacement in a horizontal direction (forward/backward direction MD) and displacement in a vertical direction (direction orthogonal to the nozzle surface 271).

As shown with the bold line in FIG. 28, when the cap pressing lever 101 is at the reset position, the cap 51 is at the risen position in a range of the rotation angle of 0 to approximately 50°, falls in a range of approximately 50 to 140°, and is held at the fallen position when the rotation angle is 140° or more. The rotation angle of 0° may be the cap closed position where the cap 51 has risen or may be the suction position where cleaning is performed. When the electric motor 71 is reverse rotation-driven in a direction of rotating the first cam 91 from the rotation angle of 0° in the clockwise direction CW, the suction pump 75 is driven with the first cam 91 being stopped at the rotation angle of 0°. In addition, the lock member 73 is at the risen position in a range of the rotation angle of 0 to 140°, falls in a range of 140 to approximately 155°, and is held at the fallen position when the rotation angle is approximately 155° or more.

For this reason, the cap 51 is at the non-capping position (open position), and has a cap closed and locked position (for example, rotation angle of 152°) where the cap is locked by the lock member 73. The cap closed and locked position corresponds to a position where the roller 583 of the cam follower 582 illustrated in FIG. 23 engages with the first recessed portion 921 in the cam unit 92 of the first cam 91. When the cap 51 is disposed at the non-capping position (fallen position) during printing in FIG. 28, the first cam 91 stops at a cap open position (rotation angle of 190°). The cap open position corresponds to a position where the roller 583 of the cam follower 582 illustrated in FIG. 23 engages with the second recessed portion 922 the first cam 91. For this reason, the stop position accuracy of the first cam 91 relatively increases at the cap closed and locked position and the cap open position. Consequently, incomplete locking or non-locking caused by variations in the stop position accuracy of the first cam 91 at the cap closed and locked position can be prevented. Since the first cam 91 is positioned at an appropriate rotation angle (190°) each time the first cam stops at the cap open position, the rotation position accuracy of the first cam 91 after then improves.

As shown in FIG. 28, the atmospheric release valve 78 opens/closes at a predetermined timing by the cam pin 941, which is engageably inserted in the cam groove 93 of the first cam 91 illustrated in FIG. 26, taking a path of (1) to (5) in FIGS. 26 and 28. When the cam pin 941 is positioned at the first cam groove portion 931 on the outer circumferential side of the first cam 91 illustrated in FIG. 26, the atmospheric release valve 78 closes. When the cam pin 941 is positioned at the second cam groove portion 932 on the inner circumferential side of the first cam 91, the atmospheric release valve 78 opens.

In FIG. 28, when the first cam 91 is in a range of the rotation angle of 0 to 205°, one position, out of the reset position and the set position, is determined for the cap pressing lever 101 by operation performed in a range of the rotation angle of the second cam 99 of 205 to 310°, and the determined position is kept. In FIG. 28, the wiper 61 is kept at the retracted position (fallen position) when the first cam 91 is in a range of the rotation angle of 0 to 205°.

As shown in FIG. 29, when the first cam 91 is in a range of the rotation angle of 190 to 310°, the cap 51 and the lock member 73 are kept at the fallen position, and the atmospheric release valve 78 is kept in an open state. The second cam 99 rotates in a range of the rotation angle of 205 to 310°. The cap pressing lever 101 revolves between the reset position and the set position at a predetermined timing by the cam pin 102, which is engageably inserted in the cam groove 100 of the second cam 99 illustrated in FIG. 27, taking a path of (1) to (5) in FIGS. 27 and 29. When the cam pin 102 illustrated in FIG. 27 is positioned at the second cam groove portion 122 on the inner circumferential side of the second cam 99, the cap pressing lever 101 is disposed at the reset position (refer to FIG. 24). When the cam pin 102 is positioned at the first cam groove portion 121 on the outer circumferential side of the second cam 99, the cap pressing lever 101 is disposed at the set position (refer to FIG. 25).

For example, when the first cam 91 and the second cam 99 rotate from the rotation angle of 205° in the counterclockwise direction CCW, the cap pressing lever 101 is set at the cap pressing set position (rotation angle of 265°) in the middle of a path (1)→(2). Even when the rotation angle becomes less than 205° by the second cam 99 being reversed in the clockwise direction CW and by taking a path (2)→(3) after rotating in the counterclockwise direction CCW, the cap pressing lever 101 is held at the reset position. In addition, even when the rotation angle becomes less than 205° by the second cam taking a path (1)→(4) by the rotation of the second cam 99, the cap pressing lever 101 is held at the set position. Since the cam follower 582 is detached from the cam unit 92 of the first cam 91 in the rotation angle of 205 to 310° at which the second cam 99 rotates, the cap 51 is at the fallen position regardless of the position of the cap pressing lever 101.

In a range of 205 to 310°, which is a rotatable range of the second cam 99, in FIG. 29, the wiper 61 moves between the retracted position Ws and the wiping position W1 (first wiping position W1). The rotation angle of 205° is a wiper setting initiation position where the wiper 61 initiates the movement from the retracted position Ws. The rotation angle of 310° is a wiper setting termination position, which is an end point position in a moving direction when setting the wiper 61 at the wiping positions W1 to W3.

In FIG. 29, when the second cam 99 rotates from the wiper setting initiation position (rotation angle of 205°) in the counterclockwise direction CCW, the wiper 61 rises in stages in the vertical direction Z at a predetermined gradient while moving in the first direction (forward direction), which is one side of the forward/backward direction MD. The wiper 61 reaches the third wiping position W3, for example, at the rotation angle of 255°. The wiper 61 reaches the second wiping position W2 (>W3) at the rotation angle of 280°. The wiper 61 reaches the first wiping position W1 (>W2) at the rotation angle of 310°. The wiping of the nozzle surface 271 by the wiper 61 is performed by the control unit 37 driving the carriage motor 28 to move the carriage 26 from the home position HP to the printing region PA and by causing the wiper 61 to slide on the nozzle surface 271.

When the second cam 99 rotates in the clockwise direction CW after the termination of wiping operation by the wiper 61, the wiper 61 falls while moving in the forward/backward direction MD and returns to the retracted position Ws. In a case where the next printing job is received and the cap 51 is to be kept at the non-capping position (open position) for the next printing after the termination of wiping operation, the wiper returns to the retracted position Ws through a path (4) shown in FIG. 29 by the rotation of the second cam 99 being controlled. When the next printing job is not received and the cap 51 is to be disposed at the capping position (closed position) without next scheduled printing after the termination of wiping operation, the wiper returns to the retracted position Ws through a path (3) shown in FIG. 29 by the rotation of the second cam 99 being controlled if necessary.

Next, operations of the liquid ejecting apparatus 11 will be described. When the liquid ejecting apparatus 11 illustrated in FIGS. 1 and 2 is turned on, the cap 51 of the maintenance device 36 is disposed at the capping position (closed position) in a state where the carriage 26 stands by at the home position HP. The cap 51 abuts against the nozzle surface 271 of the liquid ejecting head 27, and nozzle clogging is prevented by the cap 51 surrounding all of the nozzles 272. At this time, the lock member 73 rises to the locked position where the lock member engages with the carriage 26, and the carriage 26 is locked at the home position HP. In addition, the atmospheric release valve 78 is in a closed state, a space, which is surrounded by the cap 51 and the nozzle surface 271 and communicates with the nozzles 272, is blocked from the atmosphere, and nozzle clogging caused by thickening of a liquid inside the nozzles 272 is prevented.

When the control unit 37 of the liquid ejecting apparatus 11 illustrated in FIG. 2 receives a printing job, the control unit causes the liquid ejecting apparatus 11 to perform printing. The control unit 37 rotates the electric motor 71 of the maintenance device 36 forward such that the first cam 91 rotates in the counterclockwise direction CCW. As a result, the drive gear 83 and the gear 85 illustrated in FIG. 10 rotate and the gear 88 fitted into the gear 85 rotates. When the intermittent gear 90 configuring the clutch 87 rotates with a predetermined time lag after the initiation of rotation of the gear 88, the rotation of the first cam 91 is initiated. When the gear 85 is fitted into the intermittent gear 90, the rotation of the drive gear 83 and the gear 85 is directly input into the first cam 91. The first cam 91 rotates from the rotation angle of 0° in the counterclockwise direction CCW. As a result, the first cam 91 rotates from the rotation angle of 0° illustrated in FIG. 20 in the counterclockwise direction CCW (clockwise direction in FIG. 10) to the rotation angle of 190°. As a result, the cap rising/falling lever 58 is set from the second revolving posture illustrated in FIG. 20 to the first revolving posture illustrated in FIG. 21 by the roller 583 of the cam follower 582 being pressed by the cam unit 92 of the first cam 91 and being displaced. Consequently, the cap 51 falls to the non-capping position illustrated in FIG. 21.

As shown in FIG. 28, when the first cam 91 is at the rotation angle of 190°, the cap 51 is disposed at the non-capping position (fallen position) and the lock member 73 is disposed at the lock released position (fallen position). For this reason, the carriage 26 is in a lock released state and can move in the main scanning direction X. The atmospheric release valve 78 is in an open state, and the wiper 61 is disposed at the retracted position Ws (fallen position). As illustrated in FIG. 21, the roller 583 of the cap rising/falling lever 58 is pressed by the second recessed portion 922 of the first cam 91, and the first cam 91 is positioned at an appropriate rotation stop position.

Next, the control unit 37 acquires information of medium type from a printing job, drives the gap adjusting mechanism 33 before printing initiation, and adjusts the height of the liquid ejecting head 27 such that a gap according to a medium type is obtained. The liquid ejecting head 27 is disposed at any one position according to a medium type, for example, out of the three positions H1 to H3. When printing is initiated, first, the feeding unit 18 feeds the medium M, and the transporting unit 19 transports the fed medium M toward the printing region PA to a printing initiation position. After the medium M is transported to the printing initiation position, a character or an image is printed onto the medium M by repeating printing operation, in which the liquid ejecting head 27 ejects a liquid from the nozzles 272 onto the medium M while the carriage 26 moves in the main scanning direction X, and transporting operation in which the medium M is transported by the transporting unit 19 to the next printing position.

After the end of printing, the control unit 37 causes the maintenance device 36 to perform cleaning of the liquid ejecting head 27 when set length of time passes from the previous cleaning implementation time point. When the carriage 26 is disposed at the home position HP by the driving of the carriage motor 28 after printing termination, the control unit 37 reverse rotation-drives the electric motor 71 to cause the cap 51 to rise. That is, the control unit 37 reverse rotation-drive the electric motor 71 to rotate the first cam 91 from the rotation angle of 190° to the rotation angle of 0° through a path of (4)→(5) in FIGS. 26 and 28. As a result, the cap 51 rises from the non-capping position to be disposed at the capping position, and the atmospheric release valve 78 closes in a state where the lock member 73 has risen and the carriage 26 is locked at the home position HP. As the cap 51 rises to the capping position, the head guide 55 rising together engages with the liquid ejecting head 27. Thus, the cap 51 is positioned at an appropriate position with respect to the nozzle surface 271.

Even after the first cam 91 has reached the rotation angle of 0°, the control unit 37 continues the reverse rotation driving of the electric motor 71. The rotation of the first cam 91 in the clockwise direction CW beyond the rotation angle of 0° or more is restricted. For this reason, the suction pump 75 is driven with the first cam 91 being stopped at the suction position (rotation angle of 0°). Consequently, the space, which is surrounded by the cap 51 and the nozzle surface 271 and communicates with the nozzles 272, comes at negative pressure and cleaning, in which a liquid is forcibly suction-discharged from the nozzles 272, is performed. As a result of cleaning, a liquid, a thickened liquid, and bubbles can be removed from the nozzles 272.

After cleaning termination, the control unit 37 forward rotation-drives the electric motor 71. As a result, the suction pump 75 rotates reversely and is released. After a predetermined time lag from the initiation of forward rotation driving of the electric motor 71, the first cam 91 starts rotating in the counterclockwise direction CCW via the clutch 87 and rotates to a valve open position (rotation angle of 60°) ((1) of FIGS. 26 and 28). As a result, the atmospheric release valve 78 is opened. Next, the control unit 37 reverse rotation-drives the electric motor 71. As a result, the first cam 91 rotates from the valve open position to the rotation angle of 0° in the clockwise direction CW ((2) of FIGS. 26 and 28), and the suction pump 75 is driven by the reverse rotation driving of the electric motor 71 being continued. As a result, a liquid stagnating within the cap 51 is discharged to the waste liquid accommodating unit 41 without the liquid being discharged from the nozzles 272.

After then, the control unit 37 forward rotation-drives the electric motor 71, and the first cam 91 rotates in the counterclockwise direction CCW. The first cam 91 rotates to the cap open position (rotation angle of 190°). As a result, the cap 51 falls from the capping position so as to be disposed at the non-capping position. At this time, the lock member 73 falls to the lock released position, and the locking of the carriage 26 is released. In this manner, the cap 51 is disposed at the non-capping position after cleaning termination.

Next, the control unit 37 forward rotation-drives the electric motor 71 and causes the wiper 61 to wipe the nozzle surface 271. The control unit 37 selects a wiping position for that moment according to the height position H of the liquid ejecting head 27 out of the wiping positions W1 to W3. Specifically, the control unit 37 selects the first wiping position W1 when the liquid ejecting head 27 is at the first position H1, selects the second wiping position W2 when the liquid ejecting head is at the second position H2, and selects the third wiping position W3 when the liquid ejecting head is at the third position H3. The control unit 37 acquires a target rotation angle according to the selected wiping position. For example, the control unit 37 acquires the target rotation angle of 310° when the wiper is at the first wiping position W1, acquires the target rotation angle of 280° when the wiper is at the second wiping position W2, and acquires the target rotation angle of 255° when the wiper is at the third wiping position W3. The control unit 37 forward rotation-drives the electric motor 71 until the first cam 91 reaches the target rotation angle.

When the first cam 91 rotates from the cap open position (190°) to approximately 205° in the counterclockwise direction CCW, the teeth portion 91A of the first cam 91 is fitted into the teeth portion 95A of the intermittent gear 95, and the second cam 99 starts rotating in the counterclockwise direction CCW. As a result, the pinion 77 having the same shaft as the second cam 99 rotates forward. The rack member 64 that holds the wiper holding mechanism 63 via fitting of the pinion 77 into the rack 641 moves from the retracted position illustrated in FIG. 4 in the first direction shown with the arrow in FIG. 13 by the forward rotation of the pinion 77. While moving, the wiper holding mechanism 63 is kept in a state of being held by the rack member 64 by the locking of the locked part 111 (slide shaft 113) of the holding state releasing mechanism 110 by the locking part 112 (slope 115).

As the wiper holding mechanism 63 moves in the first direction, the four guide pins 651 and 652 (refer to FIGS. 4 and 16) jutting out from the back surface of the wiper holder 65 are guided along the guide holes 441 and 442 (refer to FIGS. 5 and 16). For this reason, the wiper holder 65 holding the wiper 61 moves in the first direction (one side of the forward/backward direction MD), which is a direction in which the wiper 61 heading for the wiping position W from the retracted position Ws in the forward/backward direction MD, and rises upwards in the vertical direction Z. At this time, the wiper holder 65 moves in the first direction while relatively moving upwards in the vertical direction Z with respect to the connecting unit 67 of the slide member 66. Specifically, the wiper holder 65 holding the wiper 61 rises by the roller 671 in the connecting unit 67 rolling upwards in the vertical direction Z on the inner wall surface of the guide groove 653.

For example, when the liquid ejecting head 27 is at the first position H1 (refer to FIG. 18), the first cam 91 is rotated so as to be at 310° corresponding to the first wiping position W1 (refer to FIG. 17). When the liquid ejecting head 27 is at the second position H2 (refer to FIG. 18), the first cam 91 is rotated so as to be at, for example, 280° corresponding to the second wiping position W2 (refer to FIG. 17). When the liquid ejecting head 27 is at the third position H3 (refer to FIG. 18), the first cam 91 is rotated so as to be at, for example, 255° corresponding to the third wiping position W3 (refer to FIG. 17). The control unit 37 stops the forward rotation driving of the electric motor 71 when the first cam 91 reaches the target rotation angle.

When the first cam 91 is rotated so as to be at the rotation angle of 310°, the guide pins 651 are disposed at the first flat portions 446 illustrated in FIG. 16. As a result, the wiper 61 is disposed at the first wiping position W1 illustrated in FIGS. 17 and 18. When the first cam 91 is rotated so as to be at the rotation angle of 280°, the guide pins 651 are disposed at the second flat portions 445 illustrated in FIG. 16. As a result, the wiper 61 is disposed at the second wiping position W2 illustrated in FIGS. 17 and 18. When the first cam 91 is rotated so as to be at the rotation angle of 255°, the guide pins 651 are disposed at the third flat portions 444 illustrated in FIG. 16. As a result, the wiper 61 is disposed at the third wiping position W3 illustrated in FIGS. 17 and 18.

In this manner, as illustrated in FIG. 18, the wiper 61 is disposed at the wiping positions W1, W2, and W3 according to the positions H1, H2, and H3 of the liquid ejecting head 27 according to a medium type. At this time, regardless of differences between the wiping positions W1 to W3 where the wiper 61 is disposed, the appropriate overlapping amount ΔR illustrated in FIG. 18 is ensured between the wiper 61 and the liquid ejecting head 27 in the direction orthogonal to the nozzle surface 271 (vertical direction Z).

Next, the control unit 37 drives the carriage motor 28 to move the carriage 26 in the direction shown with the arrows in FIGS. 18 and 19. As a result, the carriage 26 moves in the direction of the arrow shown with the solid line in FIG. 19 from the maintenance position (the home position HP in the example) illustrated in FIG. 18 to the printing region PA. The nozzle surface 271 is appropriately wiped by the wiper 61 sliding on in a state where the appropriate overlapping amount ΔR is ensured with respect to the nozzle surface 271 as the carriage 26 moves. The wiper 61 wipes the nozzle surface 271 in the wiping direction WD, which is a direction opposite to the moving direction (solid line arrow direction of FIG. 19) of the carriage 26. A liquid removed from the nozzle surface 271 adheres to the surface of the wiper 61, which finished the wiping of the nozzle surface 271, on the forward traveling side of the wiping direction WD.

In this manner, when wiping operation is finished, the control unit 37 drives the electric motor 71 and performs predetermined rotation control of the electric motor 71, if necessary, to cause the wiper 61 to return from the wiping position W to the retracted position Ws. When the wiper 61 returns to the retracted position Ws, the surface of the wiper 61 on the forward traveling side of the wiping direction WD comes into contact with the wiper cleaner 69 and the wiper cleaner 69 absorbs and removes a liquid adhered to the surface.

When the wiper 61 returns from the wiping position W to the retracted position Ws after the termination of wiping operation, the electric motor 71 is controlled differently according to the presence or absence of the next printing job. In other words, if there is no next printing job, the cap 51 is disposed at the capping position when the first cam 91 has returned to the suction position (0°). If there is the next printing job, the cap 51 is disposed at the non-capping position when the first cam 91 has returned to the suction position (0°).

In a case where there is no next printing job after the termination of wiping operation, the control unit 37 controls the electric motor 71 to control the rotation of the second cam 99 such that the cam pin 102 passes the path of (2)→(3) in FIGS. 27 and 29. As a result, the cap pressing lever 101 is disposed at the reset position illustrated in FIG. 20. After the second cam 99 has returned to the wiper setting initiation position (205°) and the wiper 61 has returned to the retracted position Ws, the first cam 91 rotates further to the suction position (0°). In this process, the cap 51 and the lock member 73 are displaced along the bold line of FIG. 28 in the clockwise direction CW. That is, the engagement of the cam follower 582 and the cam unit 92 is released, the cap rising/falling lever 58 revolves from the first revolving posture to the second revolving posture by the biasing force of the spring 59, and the cap holder 52 is lifted (refer to FIG. 20). As a result, in a state where the cap 51 is disposed at the capping position and the carriage 26, which has returned to the home position HP after wiping operation, is locked by the lock member 73, the nozzle surface 271 of the liquid ejecting head 27 is capped. At this time, the atmospheric release valve 78 is in a closed state (refer to FIG. 28).

On the contrary, in a case where there is the next printing job after the termination of wiping operation, the control unit 37 controls the electric motor 71 to control the rotation of the second cam 99 such that the cam pin 102 passes the path of (2)→(3)→(1)→(4) in FIGS. 27 and 29. As a result, the cap pressing lever 101 is disposed at the set position illustrated in FIG. 22. After the second cam 99 has returned to the wiper setting initiation position (205°) and the wiper 61 has returned to the retracted position Ws, the first cam 91 rotates further to the suction position (0°). In this process, the cap 51 and the lock member 73 are displaced along the one-dot chain lines of FIG. 28 in the clockwise direction CW. Since the cap pressing lever 101 holds the cap rising/falling lever 58 in the first revolving posture even when the engagement of the cam follower 582 and the cam unit 92 is released, the cap holder 52 keeps a state of being pressed (refer to FIG. 22). As a result, the cap 51 is kept at the non-capping position. At this time, the carriage 26, which has returned to the home position HP after wiping operation, is in a lock released state and the atmospheric release valve 78 is in, for example, a closed state (refer to FIG. 28).

During printing of the next printing job after then, the carriage 26 moves to the home position HP on a regular or irregular basis and the liquid ejecting head 27 performs flushing, in which a liquid is ejected from all of the nozzles 272. As a result, a liquid thickened within unused nozzles is discharged and a liquid within the nozzles 272 is refreshed. Consequently, the occurrence of a droplet ejection failure is suppressed and high-quality printing can be performed onto the medium M. At a time point when the flushing to the cap 51 is repeated for a predetermined number of times and at least a specified amount of a liquid has stagnated within the cap 51, the control unit 37 reverse rotation-drives the electric motor 71 to drive the suction pump 75. As a result, the liquid stagnating in the cap 51 is discharged by the suction pump 75 to the waste liquid accommodating unit 41 through a tube (not illustrated).

In some cases, there is an obstacle, such as the liquid ejecting head 27 and the medium M, at an irregular position within a movement region of the wiper 61 during maintenance. In such an irregular case, the wiper unit 60 of the embodiment operates as follows. The electric motor 71 rotates forward when wiping operation is initiated and the second cam 99 rotates from the wiper setting initiation position in the counterclockwise direction CCW in FIG. 29. As a consequence, as illustrated in FIG. 13, the pinion 77 rotates and the wiper moving mechanism 62 moves in the first direction (forward direction) shown with the arrow in FIG. 13.

At this time, the rack member 64 holding the slide member 66, which configures the wiper holding mechanism 63, is in a holding state of being connected to the slide member 66 via the holding state releasing mechanism 110 before releasing operation. Specifically, the slide member 66 is integrally and movably connected to the rack member 64 via the locking of the locked part 111, which is provided in the slide member 66, in the locking part 112 which is provided in the rack member 64. For this reason, the wiper moving mechanism 62 moves in the first direction shown with the arrow in FIG. 13 in a state of being integrally connected to the slide member 66 via the holding state releasing mechanism 110.

By the movement of the wiper moving mechanism 62 in the first direction, the wiper 61 is displaced and moved from the retracted position Ws to the wiping position W in the first direction and upwards in the vertical direction Z. When the wiper 61 hits an obstacle such as the liquid ejecting head 27 and the medium M at an irregular position within the movement region thereof, the wiper 61 receives a load in the direction opposite to the moving direction. At this time, as illustrated in FIG. 15, the rack member 64 continues to move in the first direction shown with the arrow in FIG. 15 but the slide member 66 receives a load from the obstacle in a direction of hindering the movement in the first direction. In other words, resistance acts on the slide member 66 in a direction opposite to the first direction. As a result, as illustrated in FIG. 15, the locking of the locked part 111 in the locking part 112 is released. Specifically, the slide shaft 113 is displaced upwards against the biasing force of the spring 114 to ride up over the slope 115, and the locking of the slide shaft 113 in the slope 115 is released. In this manner, a holding state where the rack member 64 holds the slide member 66 is released by releasing the locking of the holding state releasing mechanism 110.

When the locking of the slide member 66 in the rack member 64 is released and the holding state is released by the holding state releasing mechanism 110, relative movement between the slide member 66 and the rack member 64 is possible. As a result, as illustrated in FIG. 14, only the rack member 64 moves in the first direction by the rotation of the pinion 77 with the slide member 66 being left at a holding state releasing position. Accordingly, since the wiper 61, which hit an obstacle, does not forcibly move further, the wiper is unlikely to receive an excessive load from the obstacle. For example, even when the end portion of the wiper 61 which moves in the first direction hits the side surface of the liquid ejecting head 27 at an irregular position, the wiper 61 is prevented from being shifted or detached from the wiper holder 65. In addition, even when the wiper 61 hits a corner (edge) of the liquid ejecting head 27, a defect, such as damage and excessive deformation of the wiper 61, can be avoided since the collision force of that time is alleviated. After then, even when the carriage 26 moves for wiping operation, the wiper 61 is in a free state where the slide member 66 has broken away from the rack member 64. For this reason, since the wiper 61 can move to the retracted position Ws even when, for example, the liquid ejecting head 27 receives an external force when moving, the shift or detachment of the wiper 61 from the wiper holder 65 can be avoided at that time as well.

After then, when the control unit 37 rotates the electric motor 71 reversely, the pinion 77 rotates reversely and the rack member 64 moves in the second direction (backward direction), which is opposite to the first direction. The rack member 64 relatively moves with respect to the slide member 66 in the second direction. When the locking part 112 reaches the locked part 111 of the slide member 66, the locked part 111 is engageably locked in the locking part 112. In other words, the slide shaft 113 is pressed out along the slope 115 by the biasing force of the spring 114 and the slide shaft 113 is again engageably locked in the slope 115 in this example. In this manner, even if the holding state of the rack member 64 holding the wiper holding mechanism 63 is released when the wiper 61 hits an obstacle, the holding state releasing mechanism 110 returns to an initial holding state as the wiper 61 returns to the retracted position Ws.

For example, when a liquid, such as a special ink, has not been used for a long period of time after being used, it is necessary for the liquid ejecting apparatus 11 of the example to discharge the liquid from the liquid ejecting head 27 and to dispose the cap 51 at the non-capping position. In this case, a user operates the operation panel 15 to give a predetermined instruction. When the instruction is received from operation panel 15, the control unit 37 drives the electric motor 71 to rotate the first cam 91 in the counter-clockwise direction CCW so as to be disposed at a cap open and locked position (152°) in FIG. 28. At this time, the roller 583 of the cam follower 582 engages with the first recessed portion 921 of the first cam 91 (refer to FIG. 21), and the cap rising/falling lever 58 takes a posture in which the cap rising/falling lever has revolved slightly more in counter-clockwise direction than the first revolving posture illustrated in FIG. 21. At the cap open and locked position, the carriage 26 is locked at the home position HP by the lock member 73 in a state where the cap 51 is disposed at the non-capping position. Since the roller 583 is pressed by the first recessed portion 921 at this time, the first cam 91 is positioned at an appropriate rotation angle (152°) such that the roller 583 is positioned at the center of the first recessed portion 921. For this reason, a defect caused by variations in the rotation angle of the first cam 91 at the cap open and locked position, such as incomplete or released locking of the carriage 26, can be avoided.

According to the embodiment, the following effects can be obtained.

(1) The liquid ejecting apparatus 11 includes the maintenance device 36. The liquid ejecting apparatus 11 includes the liquid ejecting head 27 that ejects a liquid from the plurality of nozzles 272 disposed in the nozzle surface 271 and the maintenance device 36 having the wiper unit 60 that has the wiper 61, which wipes the nozzle surface 271 by relatively moving in the wiping direction WD with respect to the liquid ejecting head 27 in a state of being in contact with the nozzle surface 271. The wiper unit 60 includes the wiper moving mechanism 62 that moves the wiper 61 in the forward/backward direction MD between the wiping position, at which the nozzle surface 271 is wiped, and the retracted position Ws, which is separated away from the wiping position W1, in the direction along the nozzle surface 271. The wiper moving mechanism 62 includes the wiper holding mechanism 63 (the wiper holder 65 and the slide member 66) holding the wiper 61, the rack member 64 that moves in the forward/backward direction MD in a state of holding the wiper holding mechanism 63 in response to the receipt of a driving force from the electric motor 71 to move the wiper holding mechanism 63 in the forward/backward direction MD, and the holding state releasing mechanism 110. The holding state releasing mechanism 110 releases the holding state of the wiper holding mechanism 63 in a case where the wiper receives a load that is equal to or higher than the set value while the wiper 61 moves from the retracted position Ws to the wiping position W1. Therefore, in an irregular case where the liquid ejecting head 27 or the medium M is positioned in the movement region of the wiper 61, the occurrence of damage to the wiper 61 or other members caused by the wiper 61 coming into contact with the liquid ejecting head 27 or the medium M can be reduced. Even in a case where a relative position between the liquid ejecting head 27 and the wiper 61 at a wiping position in the orthogonal direction that is orthogonal to the nozzle surface 271 (for example, the vertical direction Z in the example) changes, wiping operation can be performed well. Even in a case where using conditions during maintenance of the liquid ejecting head 27 changes, such as the irregular position of the liquid ejecting head 27 and a change in the relative position between the liquid ejecting head 27 and the wiper 61, maintenance operation by the maintenance device 36 can be performed well.

(2) The wiper 61 is moved to the contact position where the wiper can come into contact with the nozzle surface 271 while the wiper 61 moves from the retracted position Ws that is spaced away from the nozzle surface 271 to the wiping position W1 in the orthogonal direction that is orthogonal to the nozzle surface 271. In an irregular case where the liquid ejecting head 27 or the medium M is positioned in the movement region of the wiper 61, a shock when the wiper 61 comes into contact with the liquid ejecting head 27 or the medium M while moving in the wiping position W can be reduced since the retracted position Ws is separated away from the nozzle surface 271 in the orthogonal direction. For example, in the case of a configuration where a moving mechanism, in which a wiper does not move in the orthogonal direction, is adopted, there is a possibility that the wiper heading for a wiping position from the retracted position hits the side surface or the edge of the liquid ejecting head while moving. In this case, there is a possibility that the wiper is detached from a wiper holder due to the shock occurred when hit by the side surface of the liquid ejecting head or the wiper becomes damaged when hit by the edge. However, in the embodiment, the wiper can come into contact with the nozzle surface 271 with respect to the liquid ejecting head 27 at an irregular position since the wiper 61 is displaced also in the orthogonal direction that is orthogonal to the nozzle surface 271 as the wiper moves from the retracted position Ws to the wiping position W1. For this reason, the occurrence of the shift or detachment of the wiper 61 from the wiper holder 65 or damage can be reduced.

(3) There is the second wiping position W2, which is the position of the wiper 61 during wiping closer to the retracted position Ws than the first wiping position W1 in the orthogonal direction that is orthogonal to the nozzle surface 271, between the wiping position W1 and the retracted position Ws of the wiper 61 in the forward/backward direction MD. Therefore, the wiper 61 can be disposed at the second wiping position W2 while moving from the retracted position Ws to the wiping position W1 in the forward/backward direction MD. For this reason, in a case where the position of the liquid ejecting head 27 in the orthogonal direction (for example, the vertical direction Z) is changed in order to change an interval (gap) between the liquid ejecting head 27 and the medium M, the overlapping amount ΔR of the wiper 61 and the nozzle surface 271 can be kept appropriately. In addition, the overlapping amount ΔR of the wiper 61 and the nozzle surface 271 can also be changed. For this reason, the nozzle surface 271 can be appropriately wiped by the wiper 61. As the wiper 61 moves from the retracted position Ws to the wiping position W, the wiper 61 does not take a moving path of going through a position higher than the wiping position W, which is a target thereof. For this reason, the collision of the wiper to the nozzle surface 271 at an excessive force while the wiper 61 moves to the wiping position W can be avoided.

(4) The wiper holding mechanism 63 includes the wiper holder 65 that is guided by the guide holes 441 and 442 extending in the forward/backward direction MD, that holds the wiper 61, and that is movable in the rising/falling direction intersecting the nozzle surface 271, and the slide member 66 that movably holds the wiper holder 65 in the rising/falling direction and that is connected to the rack member 64. As the slide member 66 connected to the rack member 64 moves in the forward/backward direction MD, the wiper holder 65 is guided by the guide holes 441 and 442 and moves in the rising/falling direction with respect to the slide member 66. Therefore, the wiper holding mechanism 63 can be suitably adopted as a mechanism that causes movement through which the wiper 61 is displaced in the forward/backward direction MD and the rising/falling direction.

(5) The holding state releasing mechanism 110 includes the locking part 112 provided in the rack member 64 and the locked part 111 held by the slide member 66. By the locking part 112 engageably locking in the locked part 111, the slide member 66 is held by the rack member 64. In a case where a load that is equal to or higher than the set value is received while the wiper 61 moves from the retracted position Ws to the wiping position W, the locked part 111 is movable from the locking position, at which the locked part is engageably locked in the locking part 112, to the non-locking position, at which the locked part is not engageably locked in the locking part. Therefore, this configuration can be suitably adopted as a configuration of the holding state releasing mechanism 110. In addition, a configuration where the locked part 111 is used as the slide shaft 113, which is an example of the locked member, and the slide shaft 113 is caused to be engageably locked in the slope 115, which is an example of the locked part 111, is adopted. Therefore, the holding state releasing mechanism 110 can have a relatively simple configuration.

(6) The maintenance device 36 includes the wiper cleaner 69 at a position where the wiper cleaner comes into contact with the surface of the wiper 61 on the forward traveling side of the wiping direction WD when the wiper is at the retracted position Ws. Therefore, a liquid adhered to the wiper 61 can be removed. In addition, a wiping surface of the wiper 61 can be cleaned by movement between the retracted position Ws and the wiping position W of the wiper 61.

(7) The rack member 64 has the rack 641 meshing with the pinion 77, which receives the driving force from the electric motor 71 and is fixed to the end portion of the rotation shaft 84 rotating about the axis that extends along the nozzle surface 271 and that intersects the forward/backward direction MD. Therefore, this configuration can be suitably adopted as a configuration for moving the rack member 64 in the forward/backward direction MD.

(8) The maintenance device 36 includes the cap unit 50. The cap unit 50 includes the cap 51 that is connected to the first rotating cam 91 fixed to the rotation shaft 86 rotating about the axis, which extends along the axis of the rotation shaft 84, so as to be movable between the capping position, at which space including the nozzles 272 is formed by abutting against the nozzle surface 271, and the non-capping position which is separated away from the nozzle surface 271. Therefore, this configuration can be suitably adopted as a configuration for maintaining the liquid ejecting head 27, and the wiper 61 and the cap 51 can be efficiently moved.

(9) The cap unit 50 includes the spring 59 biasing the cap 51 in a direction from the non-capping position to the capping position and the cap rising/falling lever 58 revolving between the first revolving posture in which the cap 51 is disposed at the non-capping position and the second revolving posture in which the cap 51 is disposed at the capping position. The cap unit 50 further has the first cam 91 and the cam follower 582 provided in the cap rising/falling lever 58 in a state of being engaged with the first cam 91. The first cam 91 has the cam unit 92 that causes the cap rising/falling lever 58 to revolve in the first revolving posture by being engaged with the cam follower 582. The first cam 91 allows the cap rising/falling lever 58 to revolve in the second revolving posture, in which the cap 51 is disposed at the capping position, by the biasing force of the spring 59 at a rotation angle at which engagement of the cam unit 92 and the cam follower 582 is released. Therefore, this configuration can be suitably adopted as a configuration for maintaining the liquid ejecting head 27, and the wiper 61 and the cap 51 can be efficiently moved.

(10) The cam follower 582 has the roller 583 that is engageable with the cam unit 92 of the first cam 91. The cam unit 92 has at least one engaged portion that is engageable with the roller 583 when the first cam 91 is at the rotation stop position. Out of engaged portions, at least one (two, in the example) has the recessed portions 921 and 922 that are engageable with the roller 583. Therefore, the first cam 91 is positioned at a regular rotation stop position by being engaged with the roller 583 of the cam follower 582 in a state of being pressed by the recessed portions 921 and 922 even when the rotation stop position of the first cam 91 varies. Therefore, the cap 51 can be disposed at the non-capping position (for example, FIG. 21) with relatively high position accuracy.

(11) The cap unit 50 has the second cam 99 that rotates with the rotation shaft 84. In addition, the cap unit 50 has the cap pressing lever 101 moving, according to the rotation of the second rotating cam 99, between the set position where the cap rising/falling lever 58 is held in the first revolving posture and the reset position where the revolving of the cap rising/falling lever 58 from the first revolving posture to the second revolving posture is allowed. Therefore, when the cap pressing lever 101 is disposed at the set position according to the rotation of the second rotating cam 99, the cap rising/falling lever 58 is held in the first revolving posture. When the cap pressing lever 101 is disposed at the reset position, the cap rising/falling lever 58 revolves from the first revolving posture to the second revolving posture by the biasing force of the spring 59. Therefore, the first rotating cam 91 can dispose the cap 51 at the non-capping position (FIG. 22) even when the cap rising/falling lever 58 is at a rotation angle of the second revolving posture in which the cap 51 is disposed at the capping position.

The embodiment may be a modification example in the following. In addition, a configuration included in the embodiment may be incorporated with any configuration included in the modification example below, and any configurations included in the modification example below may be incorporated with each other.

The wiping member (wiper 61) may not move between the retracted position and the wiping position in the direction orthogonal to the nozzle surface 271. In this case, the wiping member may be fixed to the slide member 66, or the wiper holder 65 may be fixed to the slide member 66.

The locking part 112 (slope 115) may be provided in the slide member 66 and the locked member (slide shaft 113) may be provided in the driving force transmitting unit (rack member 64).

Although the retracted position of the wiping member is a position below a scanning region of the liquid ejecting head in the embodiment, the retracted position may be a position that does not overlap the scanning region.

Although the maintenance device 36 is adopted in a serial printer, in which the liquid ejecting head 27 scans, in the embodiment, the maintenance device may be adopted in a line printer in which the liquid ejecting head 27 does not scan. In this case, the wiping member (wiper) may move between the retracted position positioned in a region adjacent, in a direction intersecting the transporting direction Y, to the transporting region where the medium M is transported and the wiping position overlapping the transporting region. The wiping member may move between the retracted position overlapping the transporting region and adjacent to the liquid ejecting head in the transporting direction Y and the wiping position overlapping the transporting region.

The rotating body of the cam follower may be a ball without being limited to a roller. Also in this configuration, the rotation stop position of the second cam can be adjusted such that the ball comes at the center of the recessed portion even when the rotation stop position of the second cam 99 varies with respect to a regular stop position due to the stop position accuracy of the electric motor 71, the dimensions of a component, and joining variations.

The wiping position of the wiping member (wiper 61) may be one. In addition, two or four or more wiping positions, which are different in the direction orthogonal to the nozzle surface 271, may be set. The wiping position of the wiping member may be continuously changed in the orthogonal direction that is orthogonal to the nozzle surface 271.

The plurality of wiping positions, which are different in the direction orthogonal to the nozzle surface 271, may become gradually lower or change irregularly without being limited to a configuration of becoming gradually higher as the wiper 61 heads for the wiping position W1 from the retracted position Ws.

The overlapping amount ΔR with the wiping member (wiper 61) may be adjusted by moving the liquid ejecting head 27 from a position during printing in the direction orthogonal to the nozzle surface 271. In this case, for example, even when the wiping position of the wiping member is one, the nozzle surface 271 can be wiped by the appropriate overlapping amount ΔR.

A configuration where the locking part provided in the rack member 64 is a step and the locked member provided in the slide member 66 have a slope for going beyond the step may be adopted. In contrast, the step may be provided in the slide member and the locked member having the slope may be provided in the rack member.

Any one recessed portion out of the first recessed portion and the second recessed portion may not be provided. In short, in a case where there are a plurality of rotation stop positions of the first cam 91, at which the cap 51 can be disposed at the non-capping position, the recessed portion may be provided in at least one of the plurality of engaged portions where the first cam 91 engages with the cam follower at the plurality of rotation stop positions.

A rack and pinion type moving mechanism that causes the cap holder 52 to rise/fall may be the rising/falling mechanism for the cap.

The wiping member (wiper) is configured so as to be movable in the width direction X (scanning direction) or the transporting direction Y, and the wiping member may be moved in a direction along the nozzle surface to wipe the nozzle surface. For example, the base unit of maintenance device 36 is configured to be put on a rail, the entire device is configured to be movable by the motive power of the drive source, and a configuration where the wiping member wipes the nozzle surface 271 of the liquid ejecting head 27 that stands by at a predetermined position to be wiped by the movement of the maintenance device 36 may be adopted. In addition, a configuration where the wiping member wipes the nozzle surface 271 of the liquid ejecting head 27 which stands by at the predetermined position to be wiped by the motive power of the drive source moving the whole or a part of the wiper moving mechanism may be adopted.

Without being limited to the serial printer, the liquid ejecting apparatus may be a lateral type printer in which a carriage is movable in two directions such as a main scanning direction and a sub-scanning direction.

The liquid ejecting apparatus is not limited to a printer for printing. For example, a liquid-like material formed by particles of a functional material being dispersed or mixed into a liquid may be ejected. For example, a liquid ejecting apparatus that ejects droplets of a liquid-like material formed by metal powder of a wiring material being dispersed and forms an electrical wiring pattern onto a substrate, which is an example of a medium, may be adopted. In addition, a liquid ejecting apparatus that ejects a liquid-like material formed by powder of a color material (pixel material) being dispersed onto a long substrate, which is an example of a medium, and manufactures pixels for various types of displays (display substrates for display device) such as a liquid crystal display, an electroluminescent (EL) display, and a surface-emitting display may be adopted. A liquid ejecting apparatus for three-dimensional modeling that ejects an uncured liquid resin and forms a three-dimensional object may be adopted.

The entire disclosure of Japanese Patent Application No. 2017-031390, filed Feb. 22, 2017, is expressly incorporated by reference herein.

What is claimed is:

1. A liquid ejecting apparatus comprising:

a liquid ejecting head that ejects a liquid from a plurality of nozzles disposed in a nozzle surface;

a wiping member that wipes the nozzle surface; and a wiping member moving mechanism that moves the wiping member in a forward direction from a wiping position where the nozzle surface is wiped toward a retracted position separated away from the wiping position in a direction along the nozzle surface and in a backward direction from the retracted position toward the wiping position, wherein the wiping member moving mechanism includes a wiping member holding mechanism that holds the wiping member, a driving force transmitting portion that moves in the forward direction and the backward direction by receiving a driving force from a drive source in a state of slidably holding a slide portion of the wiping member holding mechanism, the driving force transmitting portion having a locking portion that locks sliding of the slide portion and brings the slide portion into a locked state, the driving force transmitting portion moving the wiping member holding mechanism in the forward direction and the backward direction in the locked state, and a holding state releasing mechanism that releases the locked state in a case where the wiping member receives an external force in the backward direction that is equal to or higher than a predetermined value during movement of the driving force transmission portion in the forward direction.

2. The liquid ejecting apparatus according to claim 1, wherein the wiping member is moved to a contact position where the wiping member can come into contact with the nozzle surface while moving from the retracted position separated away from the nozzle surface to the wiping position in an orthogonal direction, which is orthogonal to the nozzle surface.

3. The liquid ejecting apparatus according to claim 1, wherein a position of the wiping member during wiping includes a second wiping position closer to the retracted position than the wiping position in the orthogonal direction that is orthogonal to the nozzle surface, as a position between the wiping position and the retracted position in the forward direction and the backward direction.

4. The liquid ejecting apparatus according to claim 1, wherein the wiping member holding mechanism has a holding member that is guided by a guide portion extending in the forward direction and the backward direction, that holds the wiping member, and that is movable in a rising/falling direction intersecting the nozzle surface, and a slide member as the slide portion that holds the holding member so as to be movable in the rising/falling direction and that is held by the driving force transmitting portion.

5. The liquid ejecting apparatus according to claim 4, wherein the holding state releasing mechanism has a locked member movably held by the slide member from a locking position of being engageably locked in the locking part in the locked state to a non-locking position of not being engageably locked in the case where the wiping member receives the external force while the wiping member moves from the retracted position to the wiping position.

6. The liquid ejecting apparatus according to claim 1, further comprising:

an absorbing member provided at a position where the absorbing member comes into contact with a surface of the wiping member, which is at the retracted position, on a forward direction side of the wiping direction.

7. The liquid ejecting apparatus according to claim 1, wherein the driving force transmitting unit has a rack that receives a driving force from the drive source and meshes with a gear fixed to an end portion of a rotation shaft rotating about an axis, which extends along the nozzle surface and intersects the forward direction and the backward direction.

8. The liquid ejecting apparatus according to claim 7, further comprising:

a cap that is connected to a rotating cam which is fixed to a second rotation shaft rotating about an axis along the axis of the rotation shaft so as to be movable between a capping position at which a space including the nozzles is formed by abutting against the nozzle surface and a non-capping position separated away from the nozzle surface.

9. The liquid ejecting apparatus according to claim 8, further comprising:

a biasing member biasing the cap in a direction from the non-capping position to the capping position;

a revolving member revolving between a first revolving posture in which the cap is disposed at the non-capping position and a second revolving posture in which the cap is disposed at the capping position; and a cam follower provided in the revolving member in a state of being engaged with the rotating cam, wherein the rotating cam has a cam part that causes the revolving member to revolve in the first revolving posture by being engaged with the cam follower, and allows the revolving member to be disposed in the second revolving posture, in which the cap is disposed at the capping position by a biasing force of the biasing member, at a rotation angle where engagement of the cam part with the cam follower is released.

10. The liquid ejecting apparatus according to claim 9, wherein the cam follower has a rotating body that is engageable with the cam part of the rotating cam, the cam part has at least one engaged portion that is engageable with the rotating body when the rotating cam is at a rotation stop position, and at least one engaged portion, out of the engaged portions, has a recessed portion that is engageable with the rotating body.

11. The liquid ejecting apparatus according to claim 9, further comprising, in a case where the rotating cam is used as a first rotating cam:

a second rotating cam that rotates with the rotation shaft; and a pressing lever that moves between a set position where the revolving member is held in the first revolving posture and a reset position where revolving of the revolving member from the first revolving posture to the second revolving posture is allowed, according to rotation of the second rotating cam.

12. A maintenance device comprising:

a wiping member that wipes a nozzle surface of a liquid ejecting head which ejects a liquid from a plurality of nozzles disposed in the nozzle surface; and a wiping member moving mechanism that moves the wiping member in a forward direction from a wiping position where the nozzle surface is wiped toward a retracted position separated away from the wiping position in a direction along the nozzle surface and in a backward direction from the retracted position toward the wiping position, wherein the wiping member moving mechanism includes a wiping member holding mechanism that holds the wiping member, a driving force transmitting portion that moves in the forward and backward direction by receiving a driving force from a drive source in a state of slidably holding a slide portion of the wiping member holding mechanism, the driving force transmitting portion having a locking portion that locks slide of the slide portion and brings the slide portion into a locked state, the driving force transmitting portion moving the wiping member holding mechanism in the forward direction and the backward direction in the locked state, and, a holding state releasing mechanism that releases the locked state of the wiping member holding mechanism in a case where the wiping member receives an external force in the backward direction that is equal to or higher than a predetermined value during movement of the driving force transmission portion in the forward direction.

* * * * *